US008973956B2

(12) United States Patent
Sambommatsu et al.

(10) Patent No.: US 8,973,956 B2
(45) Date of Patent: Mar. 10, 2015

(54) LATCH DEVICE

(75) Inventors: Toru Sambommatsu, Toyota (JP); Yasushi Ueki, Yokohama (JP); Syuichi Koike, Sagamihara (JP)

(73) Assignee: Nifco Inc., Yokohama-Shi, Kanagawa (JP)

( * ) Notice: Subject to any disclaimer, the term of this patent is extended or adjusted under 35 U.S.C. 154(b) by 181 days.

(21) Appl. No.: 12/998,519

(22) PCT Filed: Oct. 29, 2009

(86) PCT No.: PCT/JP2009/068607

§ 371 (c)(1),
(2), (4) Date: Jul. 8, 2011

(87) PCT Pub. No.: WO2010/050560

PCT Pub. Date: May 6, 2010

(65) Prior Publication Data

US 2011/0260474 A1 Oct. 27, 2011

(30) Foreign Application Priority Data

Oct. 29, 2008 (JP) ..... 2008-277545
Oct. 29, 2008 (JP) ..... 2008-277549

(51) Int. Cl.

| | |
|---|---|
| ***E05B 15/02*** | (2006.01) |
| ***E05C 19/02*** | (2006.01) |
| *E05C 5/00* | (2006.01) |
| *E05B 65/00* | (2006.01) |

(52) U.S. Cl.

CPC ..... *E05C 19/022* (2013.01); *E05B 65/006* (2013.01); *Y10S 292/04* (2013.01)

USPC ..... 292/341.17; 292/341.15; 292/65; 292/DIG. 4

(58) Field of Classification Search

USPC ..... 200/470, 520, 341, 523, 524; 292/52, 292/58, 65, 70, 71, 67, 83, 332, 333, 292/341.15, 341.17, DIG. 4

See application file for complete search history.

(56) References Cited

U.S. PATENT DOCUMENTS 5,090,751 A * 2/1992 Kobayashi ..... 292/71
5,217,262 A * 6/1993 Kurosaki ..... 292/6
5,273,328 A * 12/1993 Kurosaki ..... 292/336.3

(Continued)

FOREIGN PATENT DOCUMENTS

DE 4201006 A1 * 7/1992
JP 07054531 A * 2/1995

(Continued)

*Primary Examiner* — Kristina Fulton
*Assistant Examiner* — Alyson M Merlino
(74) *Attorney, Agent, or Firm* — Manabu Kanesaka

(57) ABSTRACT

A latch device has a housing, a sliding body including a striking portion abutting against a striker and disposed relative to the housing, a spring member urging the sliding body in a direction such that the sliding body protrudes from the housing, and an engaging body rotatably supported relative to the sliding body and including a claw portion on the end of the engaging body. The engaging body moves between a locking position wherein the claw portion is protruded to a striking portion side and engages with the striker, and a locking release position wherein the claw portion is retracted from the striking portion side and is released from engagement with the striker.

5 Claims, 17 Drawing Sheets

(56) References Cited

U.S. PATENT DOCUMENTS

| | | | | |
|---|---|---|---|---|
| 5,292,158 | A * | 3/1994 | Kurosaki | 292/45 |
| 6,869,114 | B2 * | 3/2005 | Ueki | 292/341.17 |
| 6,986,535 | B2 * | 1/2006 | Kawamoto et al. | 292/341.15 |
| 7,002,092 | B2 * | 2/2006 | Ichimaru | 200/523 |
| 7,108,298 | B2 * | 9/2006 | Huet et al. | 292/6 |
| 7,165,790 | B2 * | 1/2007 | Bella et al. | 292/34 |
| 7,201,409 | B2 * | 4/2007 | Adachi et al. | 292/304 |
| 7,278,664 | B2 * | 10/2007 | Su et al. | 292/304 |
| 7,393,026 | B2 * | 7/2008 | Ikeda et al. | 292/341.15 |
| 2004/0075281 | A1 | 4/2004 | Ueki | |
| 2012/0037483 | A1 * | 2/2012 | Koike | 200/470 |

FOREIGN PATENT DOCUMENTS

| | | | |
|---|---|---|---|
| JP | 2004137725 | A * | 5/2004 |
| JP | 2005129248 | A * | 5/2005 |
| JP | 2006022543 | A * | 1/2006 |
| JP | 2006214105 | A * | 8/2006 |
| JP | 2007120147 | A * | 5/2007 |
| JP | 2009185521 | A * | 8/2009 |
| JP | 2009197580 | A * | 9/2009 |
| JP | 2010106478 | A * | 5/2010 |
| JP | 2010106479 | A * | 5/2010 |
| JP | 2010192339 | A * | 9/2010 |

* cited by examiner

LATCH DEVICE

FIELD OF TECHNOLOGY

The present invention relates to a latch device used when a second member (for example, a movable body such as a lid and the like) is locked in a first member (for example, a box-like base body) so as to be removable. Especially, the invention relates to a latch device preferred for a push-and-push locking mechanism which locks an engaged/disengaged member on a second member side by a first pushing operation, and releases the locking by a next pushing operation. Incidentally, the push-and-push locking mechanism is also called a push-lock and push-open mechanism, or abbreviated as a push type.

BACKGROUND ART

FIGS. 8A, 8B show a push-type latch device disclosed in Patent Document 1. This latch device comprises a housing 1010; a sliding body 1020 including a striking portion 1022, which abuts against a striker 1090 which is the engaged/disengaged member, and a cam groove 1027, disposed inside the housing 1010, and pressed and moved against an urging force of a spring member 1040; an engaging body 1030 including a claw portion 1032*a* on an end side and a projecting portion 1036 on a base end side, and pivotally supported to the sliding body 1020; and a pin member 1050 for tracing.

The engaging body 1030 is pivotally supported in a state fitted in axis portions 1035 corresponding to axis hole portions of the sliding body 1020 and provided on both sides of the engaging body 1030. In this structure, due to a positional movement of the sliding body 1020, the engaging body 1030 moves between, as shown in FIG. 8B, a locking position wherein the claw portion 1032*a* is protruded to a striking portion 1022 side, and locks the striker 1090, and as shown in FIG. 8A, a locking release position wherein the claw portion 1032*a*is retracted from the striking portion 1022 side.

In the locking release position, the sliding body 1020 is moved to an entrance side of the housing 1010 by the urging force of the spring member 1040, and the projecting portion 1036 of the engaging body 1030 runs on an overhang portion 1016 provided inside the housing 1010, so that a state thereof is retained.

In the locking position, the sliding body 1020 is moved to a back side of the housing 1010 against the urging force of the spring member 1040 by a pushing force applied to the striker 1090, and retained in a position after the above-mentioned movement through an engagement of the cam groove 1027 and the pin member 1050. Also, the projecting portion 1036 of the engaging body 1030 moves to a low portion of a bottom of the overhang portion 1016, and the engaging body 1030 tilts so as to allow the claw portion 1032*a* to protrude from an inside of an opening 1023*a* on a sliding body side.

Specifically, in the above-mentioned latch device, due to the pushing force applied to the striker 1090 relative to the sliding body 1020, the engaging body 1030 moves from the locking release position to the locking position, and due to a next pushing force of the striker 1090 relative to the sliding body 1020, the engaging body 1030 moves from the locking position to the locking release position. At that time, an upper side of the spring member 1040 is locked in a protruding piece portion provided in a lower side middle of the engaging body 1030. In a process wherein the sliding body 1020 is pressed and moved to a back, while the spring member 1040 is accumulating urging forces, the engaging body 1030 is rotated counterclockwise in the same figure as a supporting point of the axis portions 1035, and can be moved from the locking release position to a locking positional direction.

In a case wherein the latch device is attached to a main body side and the striker 1090 is provided on a door side, FIG. 8B shows a state wherein a door is retained (locked) in a main body, and the striker 1090 on the door side is locked by the engaging body 1030 constituting the latch device on the main body side. This locking is unlocked as shown in FIG. 8A by that the door is pushed to the main body side again so that the pin member 1050 is disengaged from a locking groove of the cam groove 1027. Such structure is the same as in the latch device of Patent Document 2 or Patent Document 3.

PRIOR ART DOCUMENT

Patent Document

Patent Document 1: Japanese Published Unexamined Patent Application No. 2004-137725

Patent Document 2: Japanese Published Unexamined Patent Application No. 2001-262915

Patent Document 3: Japanese Published Unexamined Patent Application No. 2006-22543

The above-mentioned latch device is used for equipment varying in size from small to large, and for example, in response to a demand for reduction in size and weight, a latch device whose whole size is approximately 30 to 40 mm is also provided. However, in a prior structure, in order to achieve further downsizing, for example, in a length size approximately 10 to 15 mm of a housing, if a shape is simply reduced while a positional relationship between members is maintained, a rigidity force of an engaging body runs short, and also it is difficult to increase relatively only the size of the engaging body due to a matter of space.

SUMMARY OF THE INVENTION

Problems to be Solved by the Invention

There, an object of the present invention is to allow further downsizing and expand usages while a locking force or the rigidity force of the engaging body are being maintained as much as possible.

Means for Solving the Problems

In order to achieve the above-mentioned object, according to the present invention, the following latch device is provided.

(1) A latch device, comprising:

a housing;

a sliding body including a striking portion abutting against an engaged/disengaged member, and a cam groove, and disposed relative to the above-mentioned housing so as to be capable of advancing and retracting;

a spring member urging the above-mentioned sliding body in a direction protruding from the above-mentioned housing;

an engaging body rotatably supported relative to the above-mentioned sliding body, and including a claw portion on an end thereof; and a pin member moving in such a way as to trace the above-mentioned cam groove, wherein the above-mentioned engaging body can move between a locking position wherein the above-mentioned claw portion is protruded to the above-mentioned striking portion side, and locks the above-mentioned engaged/disengaged member, and a locking release position wherein the above-mentioned claw portion is retracted from the above-mentioned striking portion side, wherein when the above-mentioned sliding body is pressed and the above-mentioned sliding body moves against an urging force of the above-mentioned spring member, the above-mentioned sliding body is retained in a position after the above-mentioned movement through the above-mentioned cam groove and the pin member, and the above-mentioned engaging body moves from the above-mentioned locking release position to the above-mentioned locking position, wherein the above-mentioned engaging body includes a protruding portion protruding in the same direction as a protruding direction of the above-mentioned claw portion, wherein a pivotal supporting portion, rotatably supporting the above-mentioned engaging body to the above-mentioned sliding body, is provided in the above-mentioned protruding portion, and wherein in a state in which the above-mentioned engaging body is positioned in the above-mentioned locking position, the above-mentioned striking portion of the above-mentioned sliding body is positioned between the above-mentioned claw portion and the above-mentioned protruding portion.

(2) A latch device, comprising:

a housing;

a sliding body including a striking portion abutting against an engaged/disengaged member, and a cam groove, and disposed relative to the above-mentioned housing so as to be capable of advancing and retracting;

a spring member urging the above-mentioned sliding body in a direction protruding from the above-mentioned housing;

an engaging body rotatably supported relative to the above-mentioned sliding body, and including a claw portion on an end thereof; and a pin member moving in such a way as to trace the above-mentioned cam groove, wherein the above-mentioned engaging body can move between a locking position wherein the above-mentioned claw portion is protruded to the above-mentioned striking portion side, and locks the above-mentioned engaged/disengaged member, and a locking release position wherein the above-mentioned claw portion is retracted from the above-mentioned striking portion side, wherein when the above-mentioned sliding body is pressed and the above-mentioned sliding body moves against an urging force of the above-mentioned spring member, the above-mentioned sliding body is retained in a position after the above-mentioned movement through the above-mentioned cam groove and the pin member, and the above-mentioned engaging body moves from the above-mentioned locking release position to the above-mentioned locking position, wherein the above-mentioned striking portion of the above-mentioned sliding body is disposed on an entrance-and-exit side of the above-mentioned housing, wherein the above-mentioned cam groove of the above-mentioned sliding body is disposed on a back side of the above-mentioned housing, and wherein the above-mentioned sliding body includes a pivotal supporting portion, rotatably supporting the above-mentioned engaging body between the above-mentioned striking portion and the above-mentioned cam groove.

Incidentally, as shown in FIG. 4A, in a case wherein the latch device is disposed transversely, the above-mentioned striking portion side includes an aspect in which the claw portion is protruded in such a way as to approach the striking portion as shown in FIG. 4A.

(3) In the latch device according to (1) or (2), the above-mentioned sliding body includes:

an approximately inverted U-shaped main body; and a back extending portion protruded to a backward of the above-mentioned main body, and including a narrow width portion whose width is narrower than that of the above-mentioned main body, and wherein the above-mentioned cam groove is formed in the above-mentioned narrow width portion, wherein the above-mentioned striking portion is an inverted U-shaped front end surface of the above-mentioned main body, wherein axis holes for the above-mentioned pivotal supporting portion or axis portions are provided on both side surfaces of the above-mentioned main body, wherein the above-mentioned engaging body includes:

a front plate portion providing the above-mentioned claw portion;

a back piece portion provided so as to protrude to the backward from the above-mentioned front plate portion; and a projecting portion provided on a side surface of the above-mentioned back piece portion, and wherein the above-mentioned projecting portion runs on an overhang portion provided inside the above-mentioned housing while the projecting portion is moving to the narrow width portion of the above-mentioned back extending portion, so that the above-mentioned engaging body moves from the above-mentioned locking position to the locking release position.

(4) In the latch device according to (1) or (2), the above-mentioned engaging body is supported to the above-mentioned sliding body in such a way that a line segment connecting the above-mentioned pivotal supporting portion, which is a rotational center of the above-mentioned engaging body, and the above-mentioned claw portion in a state wherein the above-mentioned engaging body is positioned in the above-mentioned locking position, approximately corresponds to an engaging/disengaging direction of the above-mentioned engaged/disengaged member.

(5) In the latch device according to (4), the above-mentioned engaging body includes the front plate portion and the back piece portion provided so as to protrude backwardly from the above-mentioned front plate portion, wherein the above-mentioned front plate portion includes the above-mentioned claw portion, and a protruding portion maintaining a predetermined gap with the above-mentioned claw portion, provided so as to protrude in the same direction as the claw portion, and comprising an axis portion for a pivotal supporting portion, or an axis hole, wherein the above-mentioned back piece portion includes the projecting portion provided on the side surface thereof, and wherein the above-mentioned projecting portion runs on the overhang portion provided inside the above-mentioned housing, so that the above-mentioned engaging body is moved from the above-mentioned locking position to the above-mentioned locking release position.

Effect of the Invention

According to the latch device according to one embodiment of the present invention, the engaging body includes the claw portion and the protruding portion for the pivotal supporting portion provided with maintaining the predetermined gap as shown in FIGS. 4A to 4D. Also, in the state of being disposed in the locking position, the engaging body is supported relative to the sliding body in such a way that the striking portion of the sliding body is positioned between the claw portion and the protruding portion.

For this reason, according to the latch device of the present invention, a state supporting the engaging body relative to the sliding body in such a way that the back piece portion of the engaging body is entered further into the inside of the sliding body, i.e., sizes of a width direction and a thickness direction of the sliding body combined with the engaging body, and therefore a thickness of the housing, can be reduced.

Incidentally, as described in detail in the embodiment, if the sliding body is structured so as to protrude outwardly from the housing in the state wherein the engaging body is positioned in the locking release position, the length of the housing can be shortened. Also, since the pivotal supporting portion of the engaging body is disposed at a backward of the striking portion or directly beneath the striking portion, for example, respective distances between the pivotal supporting portion of the engaging body and the claw portion, and between the pivotal supporting portion and the projecting portion and the like can be freely designed, and therefore a degree of freedom for designing a shape of the engaging body can be expanded. Due to the above-mentioned factor and the like, downsizing of the latch device can be carried out.

Furthermore, as shown in FIGS. 4A to 4D, the sliding body includes the striking portion disposed on the entrance-and-exit side of the housing; the cam groove disposed on a back side of the housing; and the pivotal supporting portion whose at least one portion is disposed between the striking portion and a cam portion and supporting the engaging body. For this reason, in such a way that the back piece portion of the engaging body is entered further into the inside of the sliding body, the sizes of the width direction and the thickness direction of the sliding body combined with the engaging body, can be shortened, and the thickness of the housing can be reduced. Moreover, the length of the housing can be shortened by designing in such a way that the sliding body protrudes to the outside from the housing. Also, since the pivotal supporting portion of the engaging body is disposed at the backward of the striking portion or directly beneath the striking portion, the degree of freedom for designing the engaging body can be expanded. Due to the above-mentioned factor and the like, the downsizing of the latch device can be carried out.

BEST MODES OF CARRYING OUT THE INVENTION

Figure 1A:
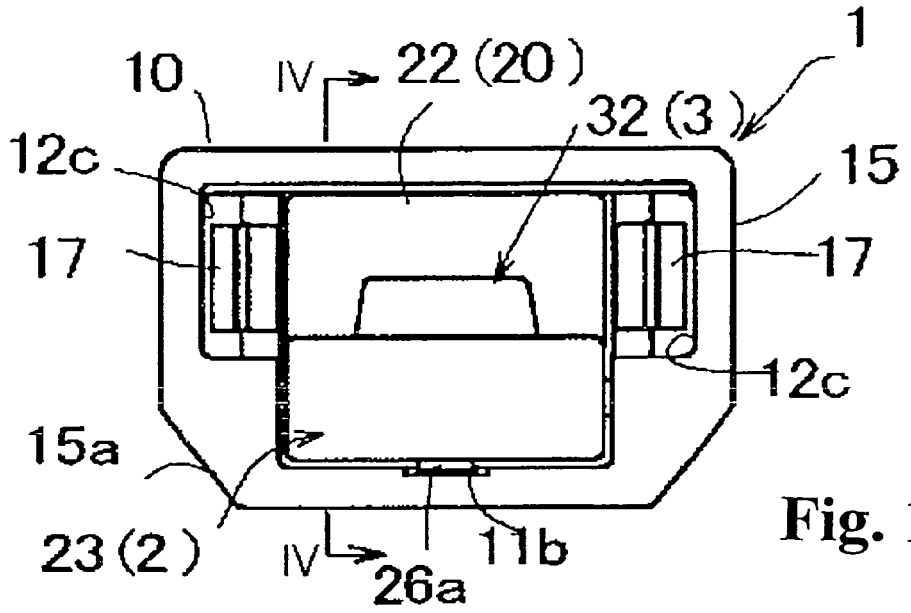
FIG. 1A is a front view of a latch device according to an embodiment of the present invention wherein an engaging body is positioned in a locking position.

Hereinafter, one embodiment of the present invention will be explained with reference to FIGS. 1A to 9C. Incidentally, in the drawings, a latch device is illustrated larger than an actual device. For example, the length size of an actual housing is approximately 15 mm or less. Also, with the exception of component drawings of FIGS. 5A to 7E, details are simplified. The following explanation will be described in detail in the order of a structure, assembly, and operation of the device.

(Structure of Device)

The latch device according to the embodiment of the present invention is a push-and-push locking mechanism which comprises a housing 1 wherein one end side is open; a sliding body 2 disposed relative to the housing 1 so as to be capable of advancing and retracting; an engaging body 3 rotatably supported relative to the sliding body 2; the engaging body 3 which moves between a locking position and a locking release position; a spring member 4 urging the sliding body 2 in a direction protruding from the housing 1; and a pin member 5 tracing a cam groove 27.

Here, the sliding body 2 includes a striking portion 22 abutting against a striker 9 as an engaged/disengaged member, and the cam groove 27. When the engaging body 3 moves to the locking position, a claw portion 32 of the engaging body 3 protrudes to a striking portion 22 side of the housing 1 so as to be capable of locking the striker 9. Specifically, a claw portion 9*a* of the striker 9 is clamped between the striking portion 22 and the claw portion 32 of the engaging body 3 protruded to this striking portion side, so that the striker 9 is locked. Also, when the engaging body 3 moves to the locking release position, the claw portion 32 of the engaging body 3 retracts from the striking portion 22 side of the housing 1 so as to release the locking of the striker 9.

By this structure, when the sliding body 2 is pressed and moved against an urging force of the spring member 4, the sliding body 2 is retained in a position after the above-mentioned movement through the cam groove 27 and the pin member 5, and the engaging body 3 moves from the locking release position to the locking position.

Figure 1B:
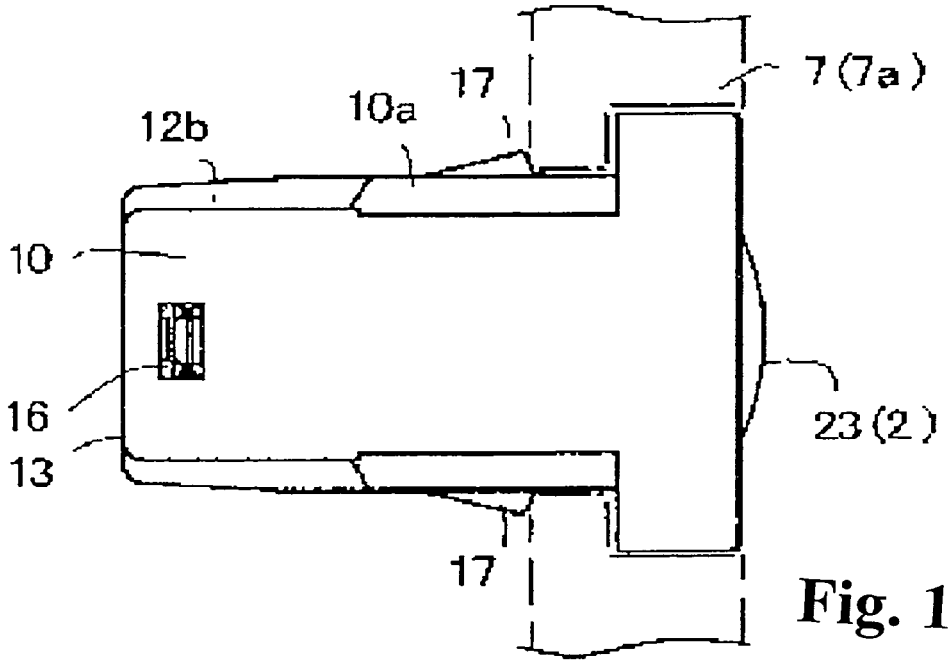
FIG. 1B is a plan view of the latch device in FIG. 1A.
Figure 1C:
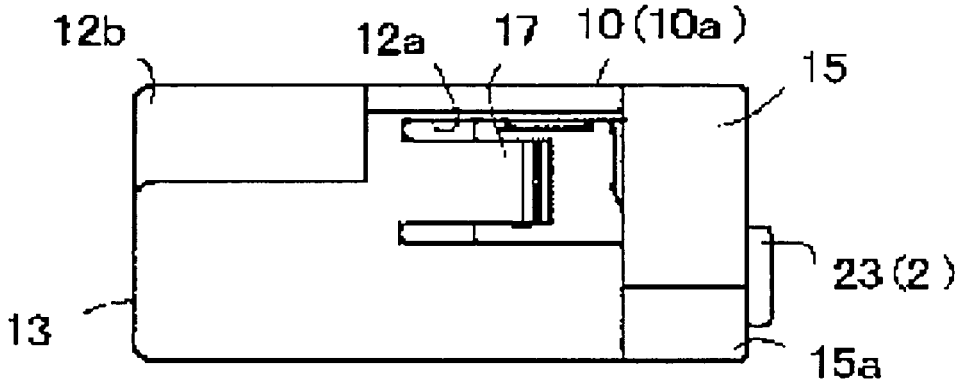
FIG. 1C is a side view of the latch device in FIG. 1A.
Figure 2A:
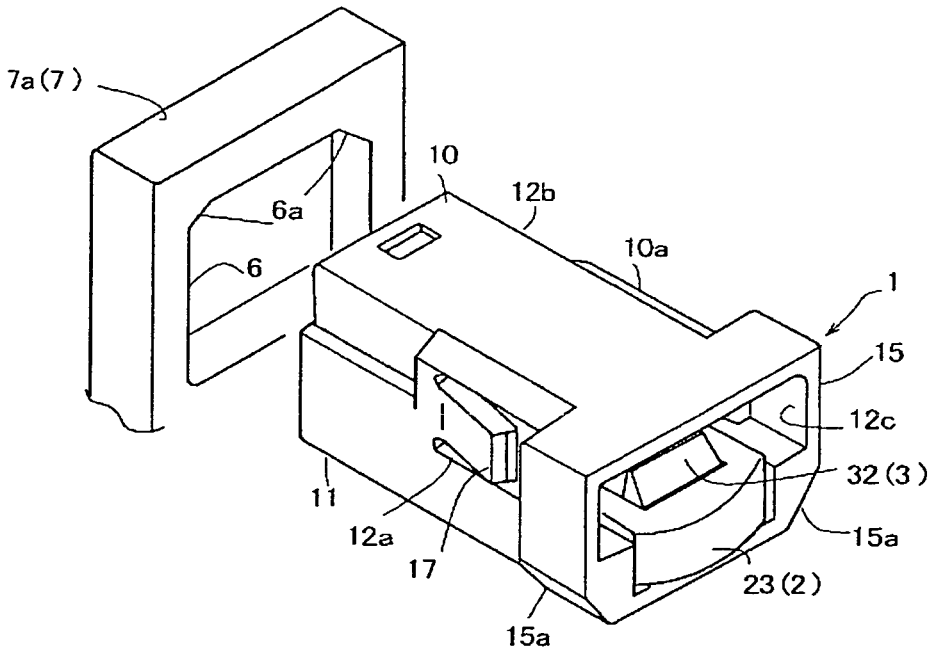
FIG. 2A is a schematic perspective view showing the latch device in FIG. 1A with an attachment frame on a main body side.
Figure 2B:
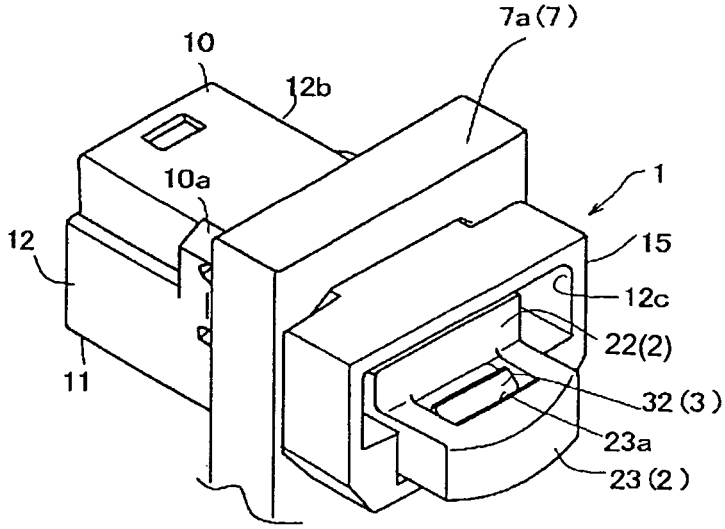
FIG. 2B is a schematic perspective view in a state wherein the engaging body of the latch device in FIG. 1A is moved to a locking release position.
Figure 4A:
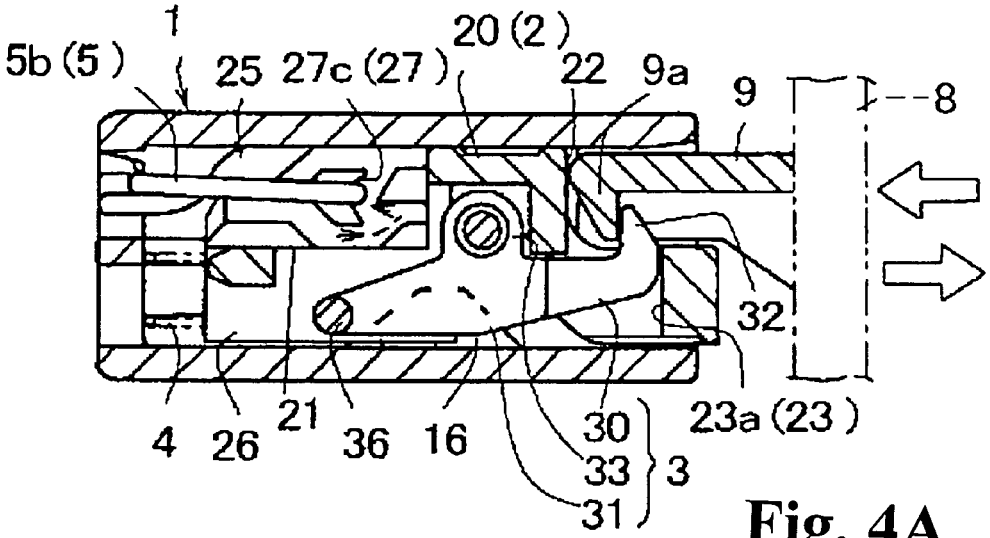
FIG. 4A is a cross-sectional view taken along a line IV-IV in FIG. 1A in the state wherein the engaging body of the latch device is moved to the locking position.

Also, this latch device is attached to an attachment frame 7*a* provided on a main body 7 side of equipment, for example, shown with a dashed line in FIG. 1B and in FIGS. 2A, 2B. In a usage example wherein the striker 9, attached to a door 8 shown with dashed lines in FIG. 4A, is engaged/disengaged, if the door 8 is pressed in a closing positional direction against an urging force of an urging member (not shown), the door 8 is locked through the striker 9. Furthermore, if the door 8 is pressed in the same direction, the locking relative to the striker 9 is released. Naturally, the latch device may be structured so as to be attached to a movable body side of the door and the like, and to engage/disengage the engaged/disengaged member attached to the main body side of the equipment. Also, although materials of the housing 1, the sliding body 2, and the engaging body 3 are resin moldings, materials other than resin may be used.

Here, as shown in FIGS. 3 and 5A to 5D, an inside of the housing 1 is formed so as to be divided by upper and lower walls 10, 11, both-side walls 12, and a bottom wall 13, and has a tube shape with a bottom whose one end side is open. Also, in the housing 1, an outer surface 15 constituting one end side of the both-side walls 12 is overhung one step, and as shown in FIG. 1B, the outer surface 15 is inserted into the attachment frame 7*a* on the main body side so as to be capable of being retained.

On an inner surface of the upper wall 10, a pair of pin controlling longitudinal ribs 14 is provided in positions corresponding to both flexural portions of the U-shaped pin member 5, and as shown in FIG. 4A, controls portions of U-shaped both-side portions 5*b* of the pin member 5. Each longitudinal rib 14 extends to a front side from the bottom wall 13, and is provided in a state wherein a back side is overhung in a one-step larger manner. Also, as shown in FIG. 4A, the longitudinal rib 14 controls a position of the U-shaped both-side portions 5*b* of the pin member 5.

On the lower wall 11, a penetration guiding groove 11*a* positioned in a middle of a front-back direction and controlling a moving range of the sliding body 2; a shallow introduction groove 11*b* communicated from one end side to the guiding groove 11*a;* and an overhang portion 16 provided so as to be projected on inner surface both sides, and allowing the engaging body 3 to rotate in a locking release direction, are provided.

On the both-side walls 12, the outer surface 15 with tapers 15*a* wherein both-side surfaces of a frame portion on an entrance-and-exit side bulge for one step, and lower corner portions are notched; elastic locking claws 17 for attachment which are divided by C-shaped slits 12*a* and whose end side overhangs outwardly; a taper 10*a* notching each corner portion of one side (although it is the upper side in FIG. 3, it may be the lower side) of opposed walls among short-shaped four corner portions up to a front of the outer surface 15 from an approximately intermediate portion of the front and back; and a notch portion 12*b* provided on a back side rather than the taper 10*a*, are provided.

On one-end side inner surfaces of the both-side walls 12, depressed escape portions 12*c* are respectively provided so as to face each other. The depressed escape portions 12*c* are the escape for a molding die in order to form the elastic locking claws 17 and the like.

On the bottom wall 13, die punching holes 13*a* passed through to lower both sides; approximately L-shaped pin insertion through-bores 13*b* passed through to upper both sides; elastic clamping pieces 13*d*, 13*e* formed between both pin insertion through-bores 13*b* so as to be divided through a small slit 13*c;* a spring supporting axis 18 protruded to an inner surface and the like, are provided. Each pin insertion through-bore 13*b* comprises a hole width slightly larger than a wire diameter of the pin member 5, and allows the approximately U-shaped pin member 5 to be inserted into a case from this hole.

Figure 1D:
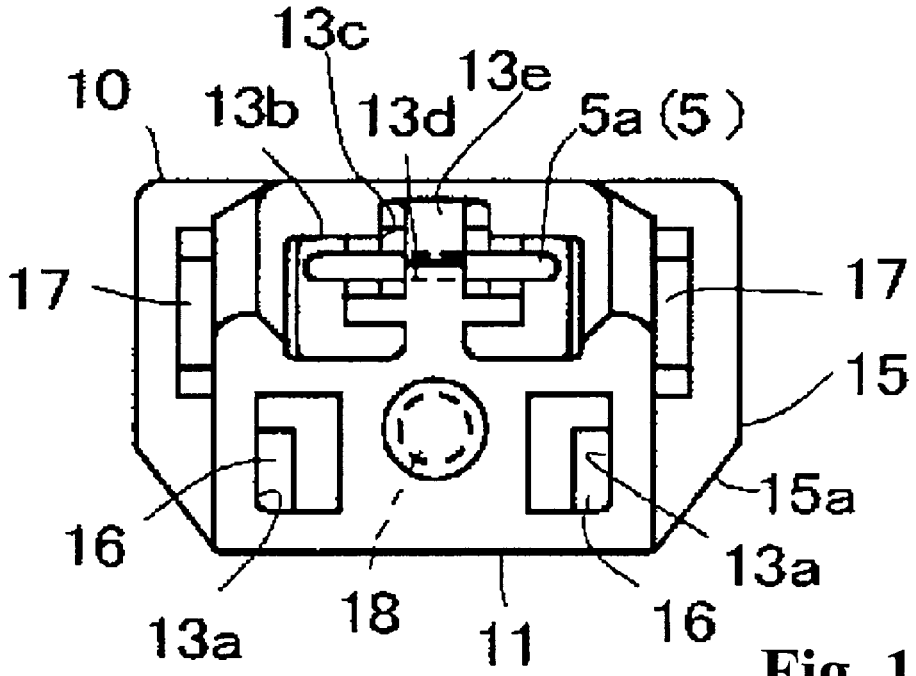
FIG. 1D is a rear view of the latch device in FIG. 1A.

The elastic clamping pieces 13*d*, 13*e* are disposed so as to face each other through a small gap, and as shown in FIG. 1D, a U-shaped intermediate portion 5*a* of the pin member 5 can retain the elastic clamping pieces 13*d*, 13*e* from the front-back direction by a predetermined clamping force. The supporting axis 18 is projected in a middle of right and left. Then, on the elastic clamping pieces 13*d*, 13*e*, the pin member 5 is pivotally supported, and on the supporting axis 18, the spring member 4 is retained. The spring member 4 is a coil spring whose lower side is placed on an axis of the supporting axis 18, and whose upper side is locked in a projecting piece portion 34 of the engaging body 3 from an inside of a tube portion 26 of the sliding body 2 described hereinafter.

Incidentally, the above-mentioned housing 1 is devised as an attachment structure to the main body 7 side from a standpoint of downsizing as described hereinafter. Specifically, in a prior structure (for example, see Patent Document 1), since the housing is placed on an attachment frame on the main body side by an insertion operation, the housing includes a retaining frame portion overhanging for one step on an outer circumference of an entrance-and-exit side of the housing; and elastic locking claws (which are the same as the above-mentioned elastic locking claws 17) provided on the above-mentioned facing wall surfaces. Also, although it is not shown in Patent Documents 1 to 3, there was a case in which a positioning projected piece was provided in the housing in a longitudinal direction (from a back side up to a front of the retaining frame portion), and the projected piece thereof was fitted in a depressed piece on an attachment frame side.

On the other hand, in the latch device of the present invention, in place of the prior retaining frame portion, in the frame portion on the entrance-and-exit side of the housing 1, only both-side surfaces 12, 12 are bulged for one step, and the outer surface 15 with the tapers 15*a* is provided, so that the upper and lower surfaces 10, 11 have been attempted to be slimmed. Also, in place of the positioning projected piece provided on a prior outer surface in the longitudinal direction, each corner portion (in this example, both corner portions of the upper wall 10) of one side of the opposed walls in a tube portion dividing the housing 1 is formed in the positioning taper 10*a* notched up to the front of the outer surface 15, so that the slimming of the outer circumference has been attempted. Naturally, in this structure, a fitting hole 6 corresponding to a cross-sectional surface of the housing 1, i.e., a positioning tapered corner portion 6*a* corresponding to the taper 10*a* is required for the attachment frame 7*a*.

As shown in FIGS. 3 and 6A to 6E, the sliding body 2 comprises an approximately inverted U-shaped main body 20 disposed on the entrance-and-exit side of the housing 1; and a back extending portion 21 provided so as to be protruded to a backward of the main body 20, and whose width is narrower than that of the main body 20. The main body 20 divides an approximately inverted U-shaped hollow portion 24 which is open downwardly, and a front end surface is set as the striking portion 22. Also, the main body 20 includes a frame portion 23 provided so as to be projected to a front from a lower portion of the front end surface; axis holes 24*a* for a pivotal supporting portion provided on the same axis line relative to both-side surfaces 20*b* dividing the hollow portion 24; and a through-bore 20*d* formed on both sides of a portion where the back extending portion 21 protrudes among a back surface side facing the striking portion 22. In other words, the hollow portion 24 of the main body 20 is divided by the striking portion 22, an upper surface 20*a*, both-side surfaces 20*b*, and a front end side of the back extending portion 21. The upper surface 20*a* includes a front rib and a back rib, and thereby, at a time of being disposed inside the housing 1, an excellent sliding characteristic can be obtained. The frame portion 23 forms an opening 23*a* which allows the claw portion 32 of the engaging body 3 described hereinafter to appear and disappear with plenty of room.

The back extending portion 21 is structured by an upper portion 25 forming the heart-shaped cam grooves 27 on both sides; and the tube portion 26 on a lower side extending in the same direction as the upper portion 25 thereof.

Figure 6A:
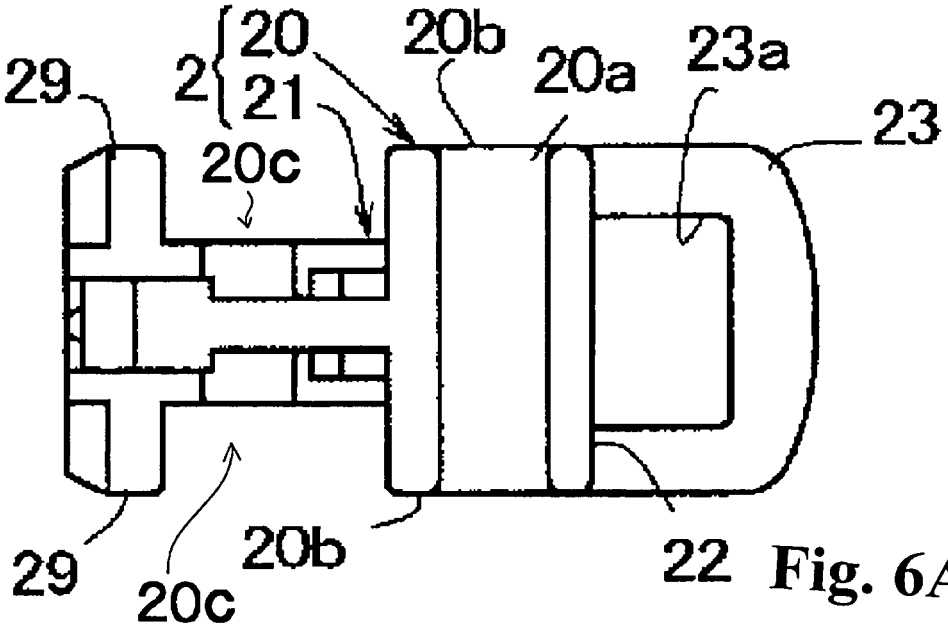
FIG. 6A is a plan view of the sliding body of the latch device in FIG. 1A.
Figure 6B:
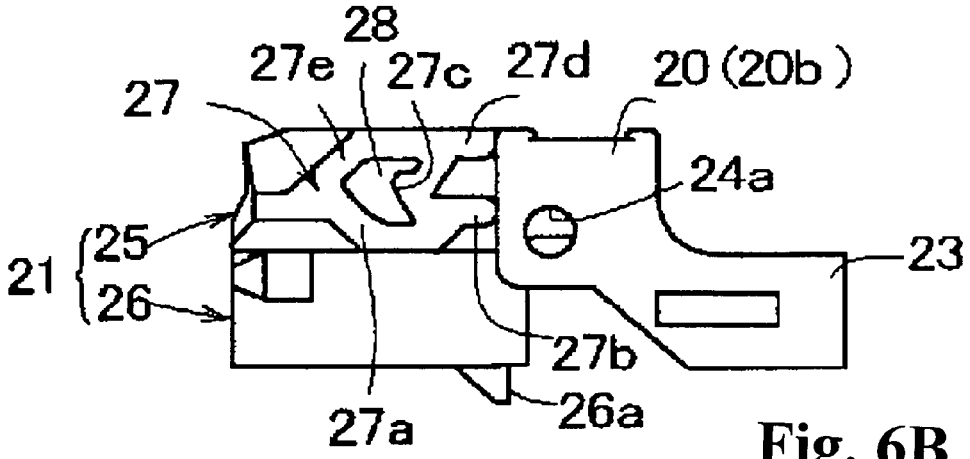
FIG. 6B is a side view of the sliding body in FIG. 6A.
Figure 6C:
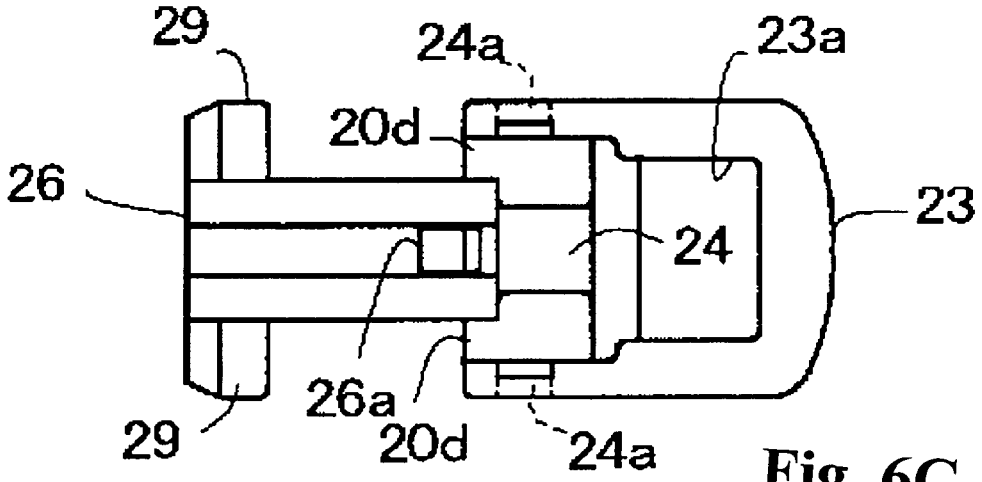
FIG. 6C is a bottom view of the sliding body in FIG. 6A.
Figure 6D:
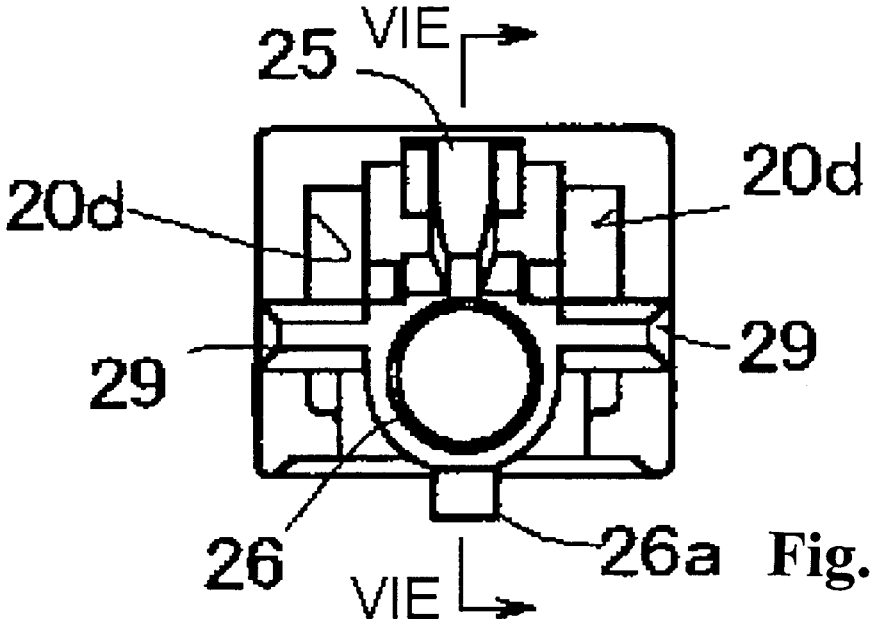
FIG. 6D is a rear view of the sliding body in FIG. 6A.
Figure 6E:
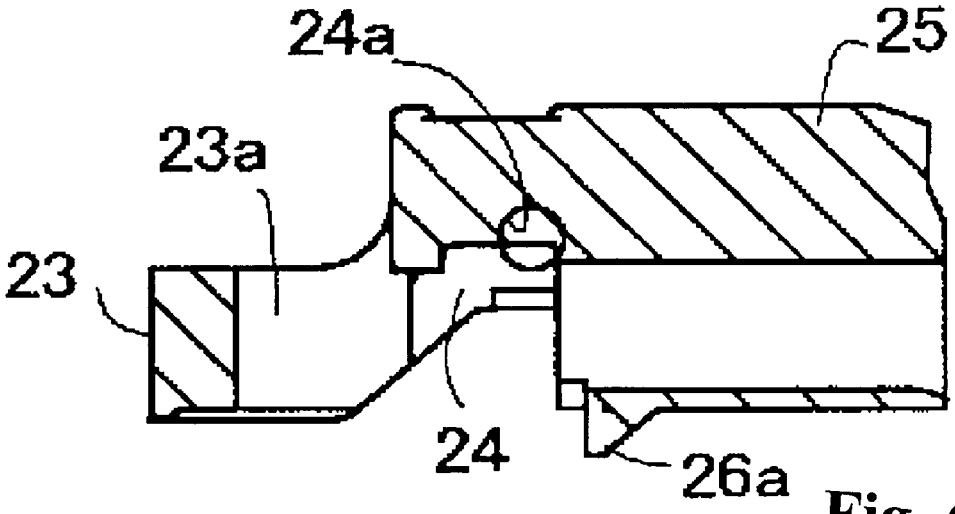
FIG. 6E is a sectional view taken along a line VIE-VIE in FIG. 6D of the sliding body in FIG. 6D.
Figure 7A:
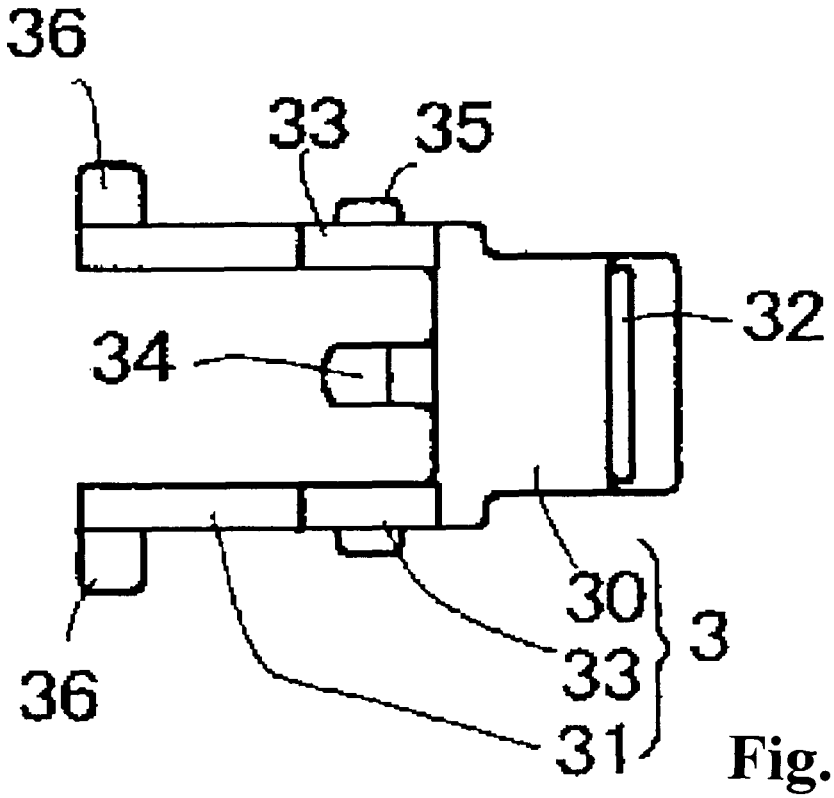
FIG. 7A is a plan view of the engaging body of the latch device in FIG. 1A.
Figure 7B:
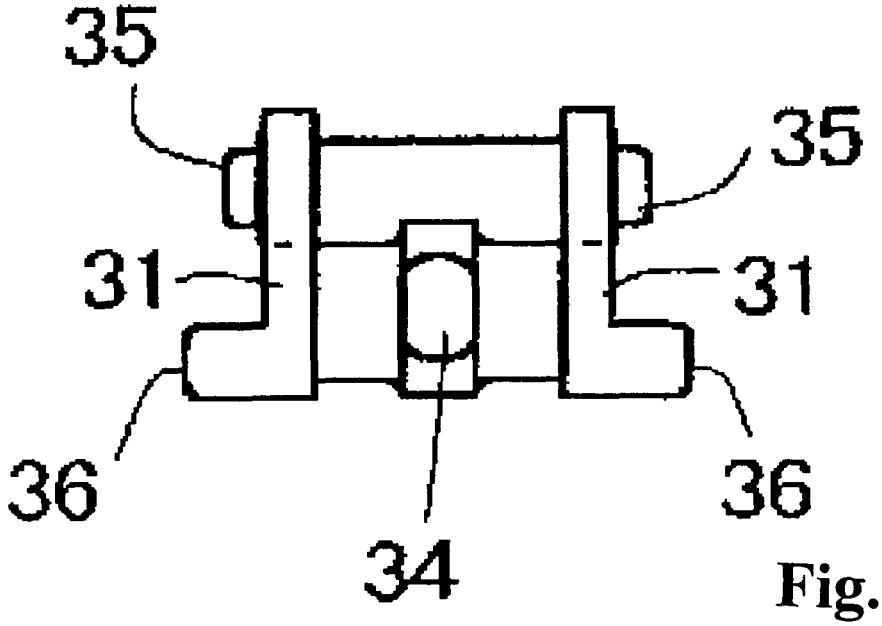
FIG. 7B is a rear view of the engaging body in FIG. 7A.
Figure 7C:
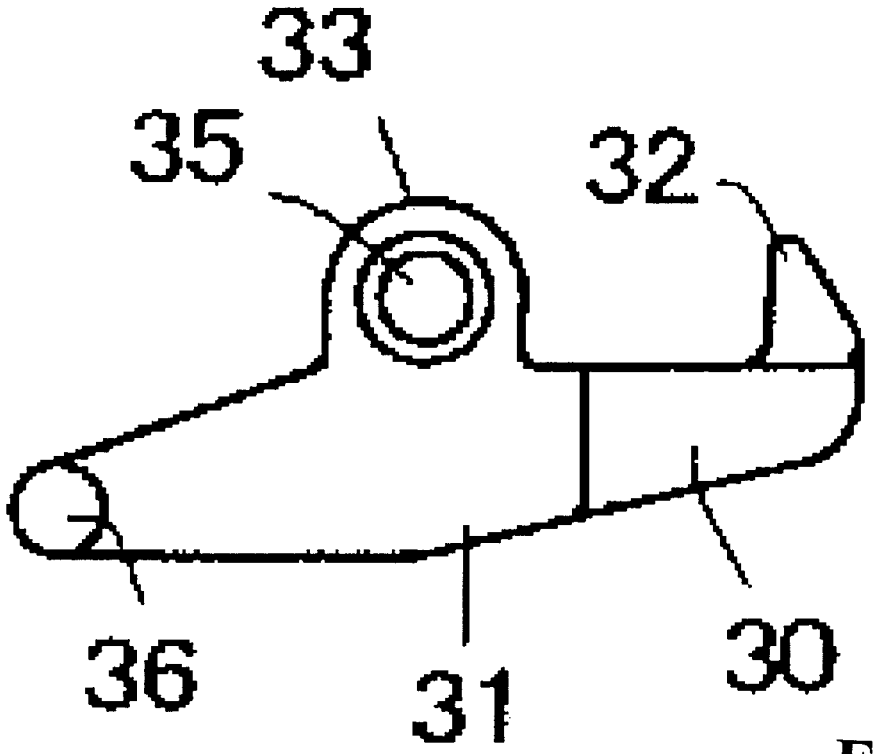
FIG. 7C is a side view of the engaging body in FIG. 7A.
Figure 7D:
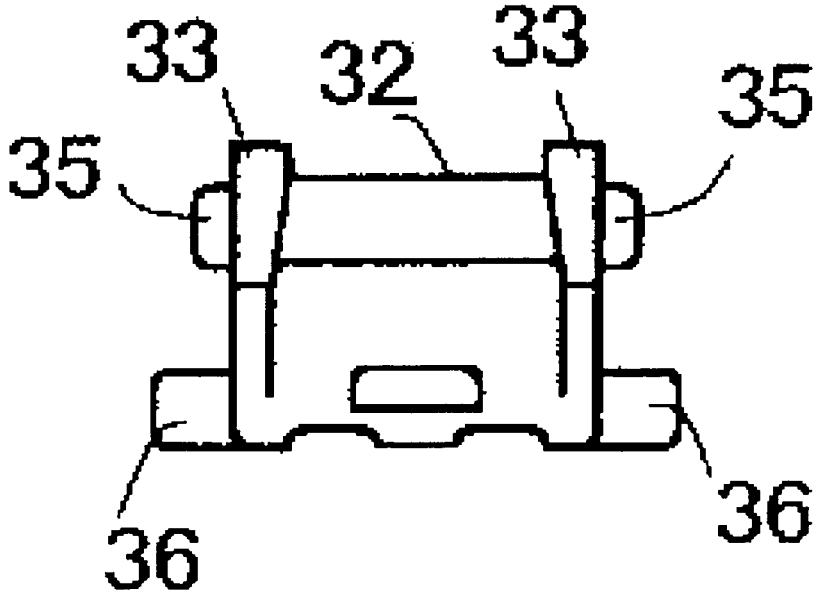
FIG. 7D is a front view of the engaging body in FIG. 7A.
Figure 7E:
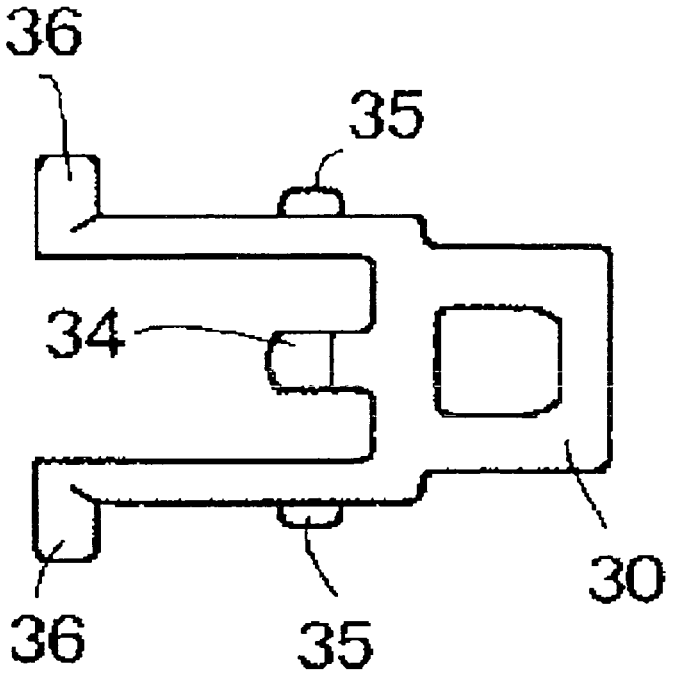
FIG. 7E is a bottom view of the engaging body in FIG. 7A.

As shown in FIG. 6D, the cam grooves 27 on both sides have mutually the approximately same shape, and are provided around a projected cam island 28. The cam groove 27 is structured by a guidance groove 27*a* extending to a front lower side from a back side; a locking guidance groove 27*b* and a releasing guidance groove 27*d* which are located in a front side of the guidance groove 27*a* and are split up and down; a depressed locking groove 27*c* positioned between the guidance grooves 27*b*, 27*d*, and also positioned at the back side; a return groove 27*e* extending from the guidance groove 27*d* to the back side, and the like.

The tube portion 26 forms a tube bore whose inside can loosely fit the above-mentioned supporting axis 18 and an upper side of the spring member 4. The tube portion 26 includes a projection 26*a* provided so as to be projected from the front lower side and fitted in the above-mentioned guide groove 11*a*, and a guiding small wing 29 provided so as to be projected toward both sides at a back upper side.

However, the above-mentioned sliding body 2 is devised as follows from the standpoint of the downsizing. Specifically, in this structure, the sliding body 2 is protruded to an outside of the housing at the locking release position of the engaging body 3 described hereinafter relative to the housing 1, and a size of a length direction of the housing 1 is shortened. Additionally, the sliding body 2 includes the back extending portion 21 protruded from the backward of the main body 20 and forming an escape portion, which is notched so as to have a width thinner than that of the main body, and the cam groove 27. Also, the main body 20 includes the hollow portion 24 provided on a back side of the striking portion 22 and divided at least by the both-side surfaces 20*b*; and the axis holes 24*a* for the pivotal supporting portion provided on each side surface 20*b*. Specifically, since the axis holes 24*a* for the pivotal supporting portion (in place of the axis holes 24*a*, axis portions may be used) are provided at a backward of the striking portion 22 or directly beneath the striking portion 22, back piece portions 31 of the engaging body 3 are inserted further into an inside of the sliding body, so that sizes of a width direction and a thickness direction in a state wherein the engaging body 3 is pivotally supported to the sliding body 2, are shortened. Thereby, a degree of freedom for designing a size or a shape of the engaging body 3 can be expanded so as to facilitate the downsizing of the whole latch device.

Figure 3:
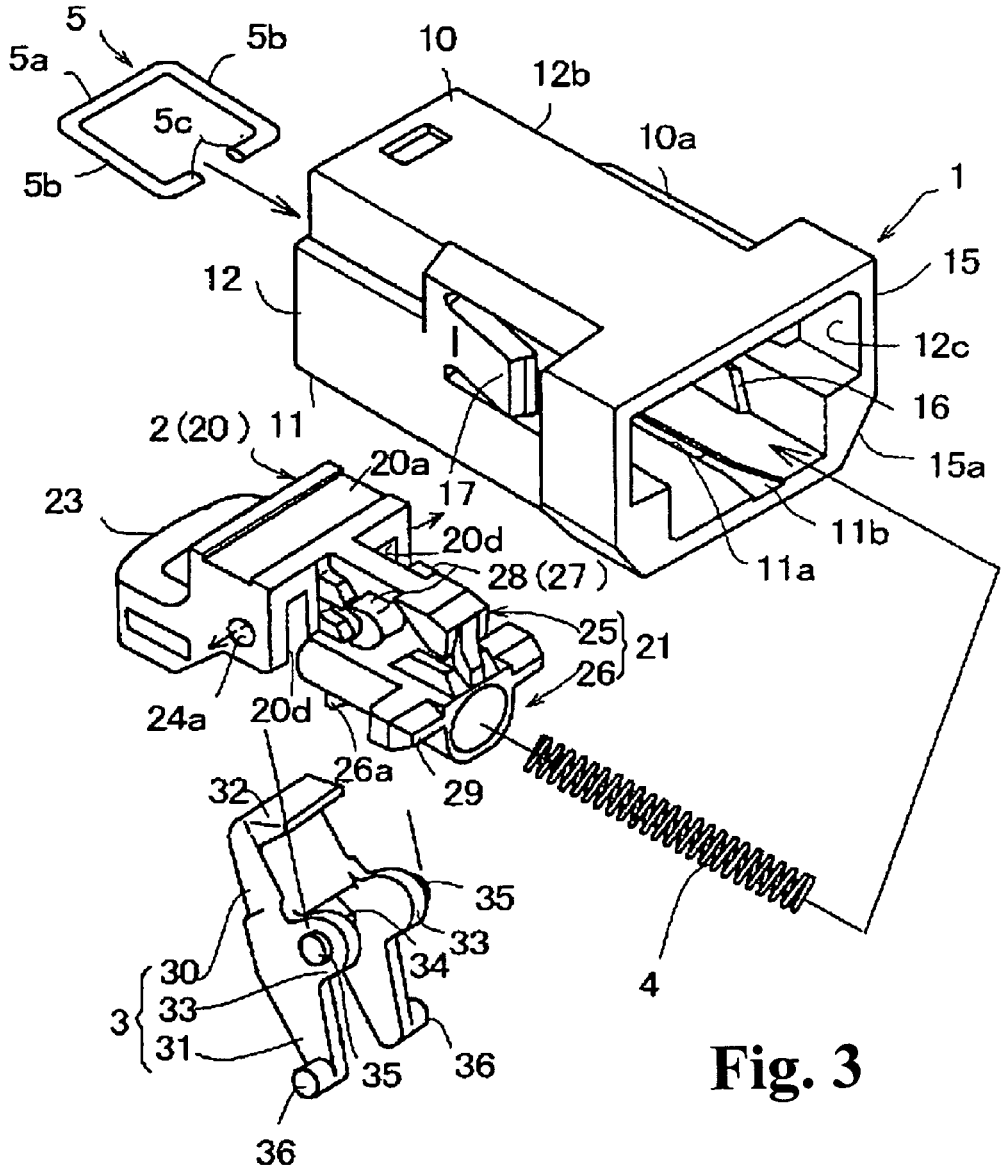
FIG. 3 is a schematic exploded view showing a relationship between members of the latch device in FIG. 1A.

As in a prior art, the pin member 5 comprises, as shown in FIG. 3, the U-shaped intermediate portion 5*a*; the both-side portions 5*b*; and ends 5*c* in which a free end side of each side portion 5*b* is folded back to an inside. An upper width size of a U shape is formed slightly larger than a lower width size. The lower width size is located inside the housing 1, and approximately corresponds to a width size between the inner surfaces of the both-side walls 12.

Figure 8A:
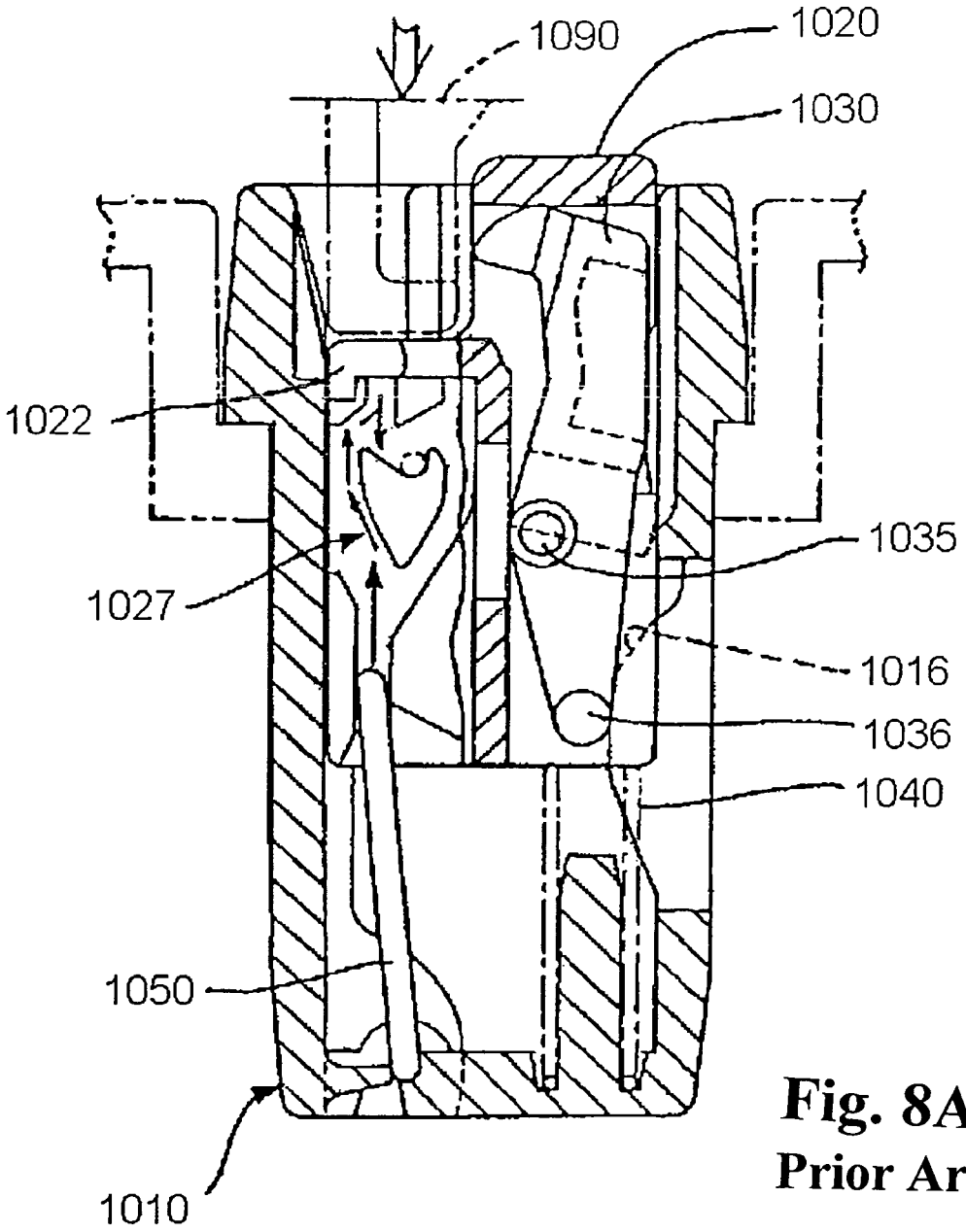
Fig. 8A Prior Art
FIG. 8A is a cross-sectional view of a state wherein an engaging body of a prior latch device is positioned in the locking release position.
Figure 8B:
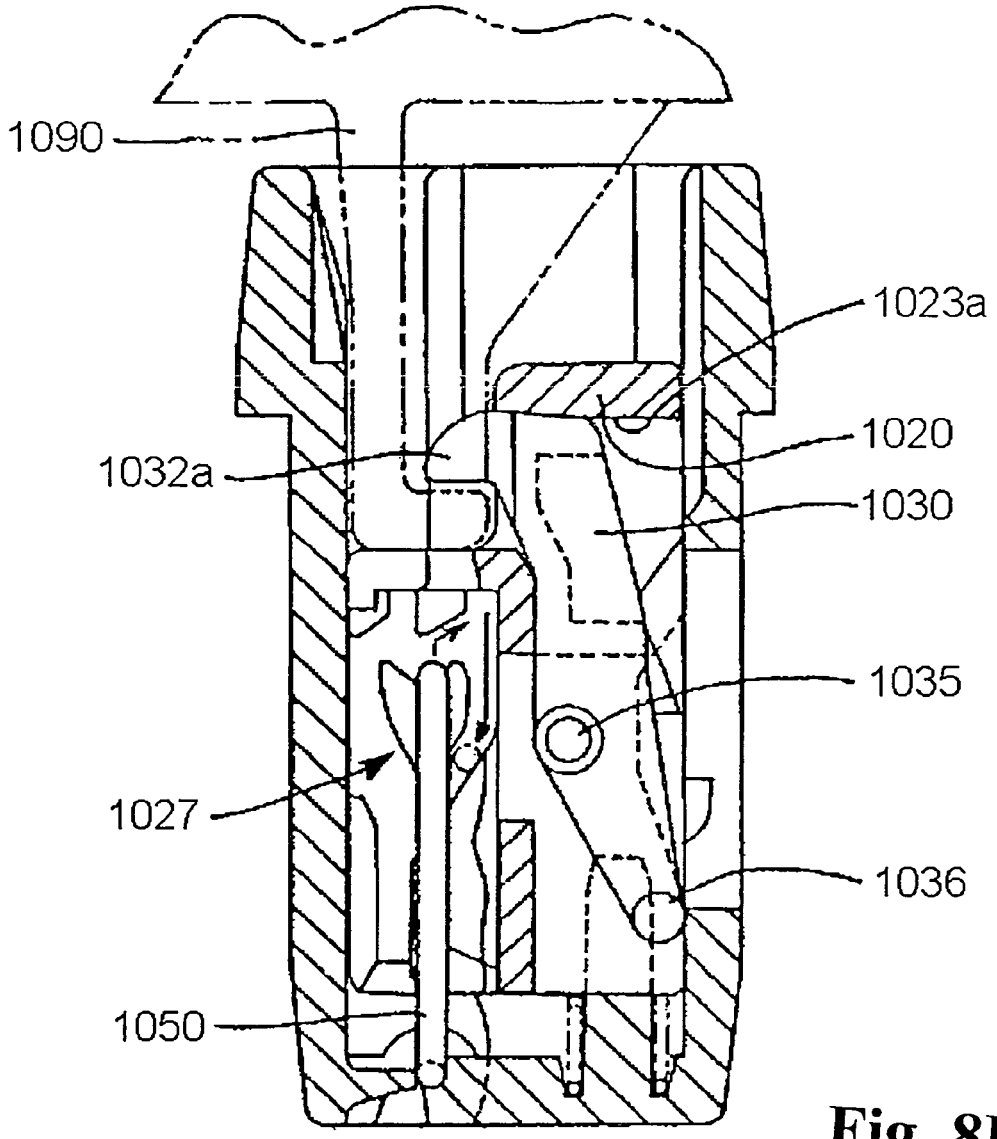
Fig. 8B Prior Art
FIG. 8B is a cross-sectional view in a state wherein the engaging body of the prior latch device is positioned in the locking position.

As shown in FIGS. 3, 8A, 8B, the engaging body 3 comprises a front plate portion 30; the back piece portions 31, 31 provided so as to project to a backward from the front plate portion 30. In the front plate portion 30, the claw portion 32 protruding to an upper side; protruding portions 33 maintaining the predetermined gap with the claw portion 32 and also protruding in the same direction as a protruding direction of the claw portion; and the protruding piece portion 34 protruded in a middle of a right and left direction of a back end surface, and entering into a tube of the above-mentioned tube portion 26, are provided. The claw portion 32 has a size which can freely advance and retract relative to the opening 23*a* on a sliding body side. On both protruding portions 33, axis portions 35 for pivotal supporting are formed so as to protrude on the same axis line. On back outside surfaces of both back piece portions 31, projecting portions 36 are respectively provided.

However, the above-mentioned engaging body 3 is devised as follows from the standpoint of the downsizing. Specifically, the protruding portions 33, maintaining the predetermined gap with the claw portion 32, protruding in the same direction as the protruding direction of the claw portion, and forming the axis portions 35 (may be axis holes) for the pivotal supporting portions, are provided in the engaging body 3. This engaging body 3 is pivotally supported relative to the main body 20 on the sliding body side due to the fitting of the axis portions 35 and the axis holes 24*a*, and the engaging body 3 can move between the locking position and the locking release position. In a state in which the engaging body 3 is positioned in the locking position, the striking portion 22 is positioned between the claw portion 32 and the protruding portions 33. Also, in a state in which the engaging body 3 is positioned in the locking release position, the back piece portions 31 and the projecting portions 36 are allowed to escape to portions (a symbol 20*c* in FIG. 6A) which become thin of the back extending portion 21 on the sliding body side.

For this reason, by structuring the latch device in such a way that the back piece portions 31 of the engaging body 3 are inserted further into the inside of the sliding body 2, sizes of the width direction and the thickness direction in the state wherein the engaging body 3 is supported relative to the sliding body 2, are easily reduced. Also, since a rotational center (the axis portions 35 fitted in the axis holes 24*a*) of the engaging body 3 is set at the backward of the striking portion or directly beneath the striking portion 22, the engaging body 3 can be further downsized by arbitrarily setting a distance between the axis portions 35 which are the pivotal supporting portion and the claw portion 32, a distance between the axis portions 35 and the projecting portions 36, and the like.

(Assembling Method)

In the above-mentioned each member, for example, first, the engaging body 3 is assembled to the sliding body 2. Specifically, from a state in FIG. 3, the axis portions 35 on both sides are pushed into the axis holes 24*a* from an inside of the hollow portion of the sliding body 2.

Then, the engaging body 3 is pivotally supported so as to be capable of freely rotating within a predetermined range as a supporting point of the axis portions 35. The engaging body 3 can move between, as shown in FIGS. 2B and 4C, the locking release position wherein the claw portion 32 is housed inside the opening 23*a*, and as shown in FIGS. 2A and 4A, the locking position wherein the claw position 32 is protruded from the opening 23*a*, and the projecting portion of the striker 9 or the claw 9*a* are clamped between the striking portion 22 of the sliding body 2 and the claw portion 32 of the engaging body 3. Also, this engaging body 3 is pivotally supported relative to the main body 20 on the sliding body side through the fitting of the axis holes 24*a* and the axis portions 35, and in a state positioned in the locking position wherein the claw portion 32 is protruded from the opening 23*a* to the striking portion 22 side, the striking portion 22 is positioned between the claw portion 32 and the protruding portions 33. Also, in a state disposed in the locking release position wherein the claw portion 32 retracts to an inside of the opening 23*a*, the back piece portions 31 of the engaging body 3 and the projecting portions 36 are allowed to escape to the escape portion wherein the back extending portion 21 becomes thin.

Next, the sliding body 2, where the above-mentioned engaging body 3 is assembled, is assembled to the inside of the housing 1. In this operation, for example, the spring member 4 is placed in an axis of the supporting axis 18 in advance, the pin member 5 is retained in the bottom wall 13 so as to be capable of swaying, and then the spring member 4 and the pin member 5 are respectively disposed inside the housing 1.

As for the pin member 5, after the ends 5*c* on both sides are inserted into the housing from each pin insertion through-bore 13*b*, the U-shaped intermediate portion 5*a* is forcibly moved toward the elastic clamping pieces 13*d*, 13*e*, and the pin member 5 is clamped between both clamping pieces 13*d*, 13*e* thereof. In this clamped state, the pin member 5 is retained so as to stand up inside the housing 1, and the position of the U-shaped both-side portions 5*b* is controlled between the controlling longitudinal ribs 14 and the side surfaces 12 of the housing 1. Also, when the sliding body 2 in which the engaging body 3 is assembled is pushed into the housing 1, the projection 26*a* of the sliding body 2 falls in the guiding groove 11*a* from the introduction groove 11*b*, and fitted in, so that the sliding body 2 is retained relative to the housing 1, and assembled. In this pushed-into process, the upper side of the spring member 4 is entered into the tube portion 26, and abuts against the projecting piece portion 34 of the engaging body 3. Then, in a process wherein the sliding body 2 is pressed and moved to a back, the spring member 4 increases urging forces, and due to the urging forces, the engaging body 3 can be rotated in a locking positional direction as the supporting point of the axis portions 35. Also, both ends 5*c* of the pin member 5 are entered into a groove entrance of the corresponding cam groove 27.

(Operation)

A usage aspect of the latch device of the present invention, which has been completed by the above-mentioned assembling method, will be explained.

For example, as shown in FIG. 1B, the latch device of the present invention is inserted into the attachment frame 7*a* provided on a main body 7 on an equipment side, and as shown in FIG. 4A, the latch device is attached to the striker 9 which is attached to the door 8 through the elastic locking claws 17 and the like. Usually, in an attachment state of the latch device of the present invention, as shown in FIG. 2B, the sliding body 2 is urged in a protruding direction by the spring member 4, and likewise, the claw portion 32 of the engaging body 3 is urged by the spring member 4 in a direction of entering into the opening 23*a* on the sliding body side. Incidentally, the projection 26*a* abuts against a front end surface of the guiding groove 11*a*, so that a movement of the sliding body 2 is controlled. Also, the projecting portions 36 run on a portion which is the highest portion of the overhang portion 16, so that a rotation of the claw portion 32 is controlled. This state is the "locking release position of the engaging body 3".

Then, when the door 8 is pushed in a left arrow direction in FIG. 4A which is a closing direction, the sliding body 2 is pressed and moved by the striker 9 against the urging force of the spring member 4 in a direction of disappearing inside the housing. In a moving process thereof, the engaging body 3 is rotated as the supporting point of the axis portions 35 in the locking positional direction. Then, the projecting portions 36 elastically move to a low side of the overhang portion 16, and at the same time, the engaging body 3 retains the claw 9*a* of the striker 9 through the claw portion 32. At this time, as shown in FIG. 4A, each end 5*c* of the pin member 5 is entered into the locking guidance groove 27*b* from the above-mentioned guidance groove 27*a* by a backward movement of the sliding body 2 and the engaging body 3, and when a pressing force in the left arrow direction is released, the engaging body 3 is locked in the locking groove 27*c*. Due to this locking, the door 8 is retained (locked) in a closed state.

Figure 4B:
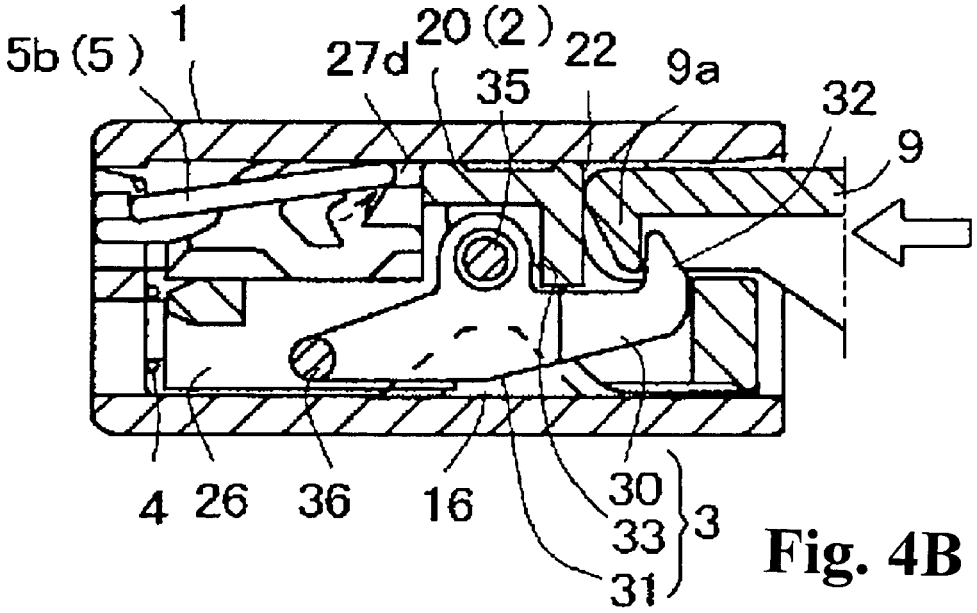
FIG. 4B is a cross-sectional view taken along a line IV-IV in FIG. 1A in the state wherein the engaging body of the latch device is unlocked.
Figure 4C:
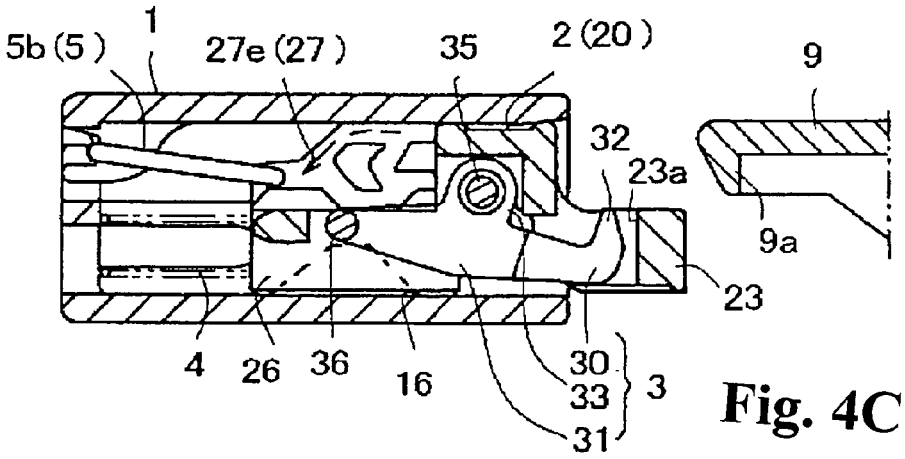
FIG. 4C is a cross-sectional view taken along a line IV-IV in FIG. 1A in the state wherein the engaging body of the latch device is moved to the locking release position.
Figure 4D:
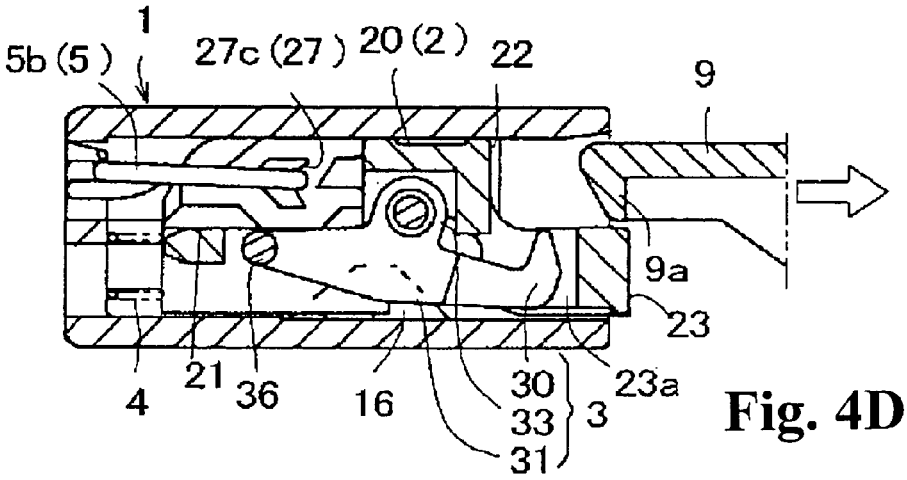
FIG. 4D is a cross-sectional view taken along a line IV-IV in FIG. 1A in the state wherein a striker of the latch device is forcibly pulled out by receiving an external force in a pullout direction.
Figure 5A:
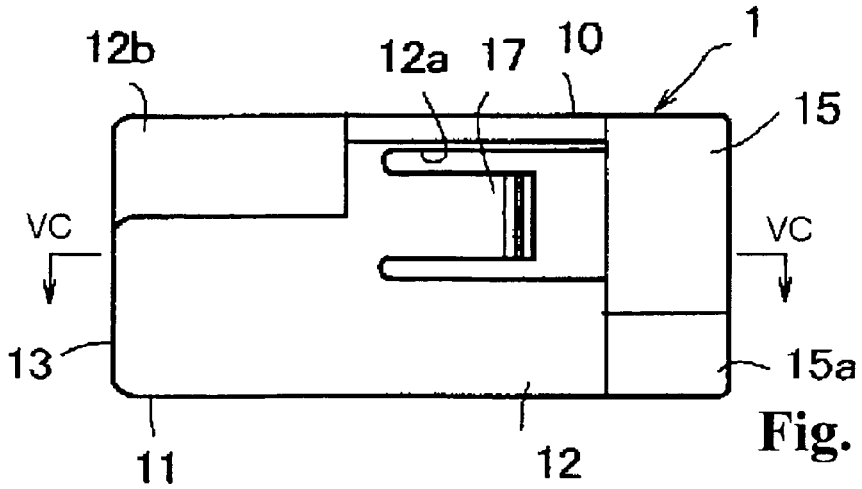
FIG. 5A is a side view of a housing of the latch device in FIG. 1A.
Figure 5B:
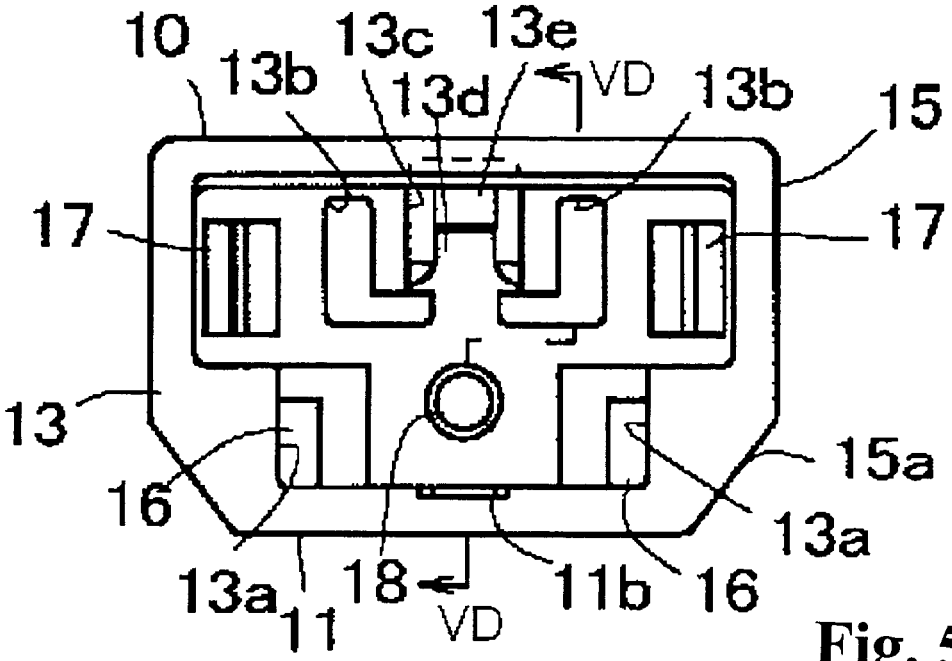
FIG. 5B is a front view of the housing in FIG. 5A.
Figure 5C:
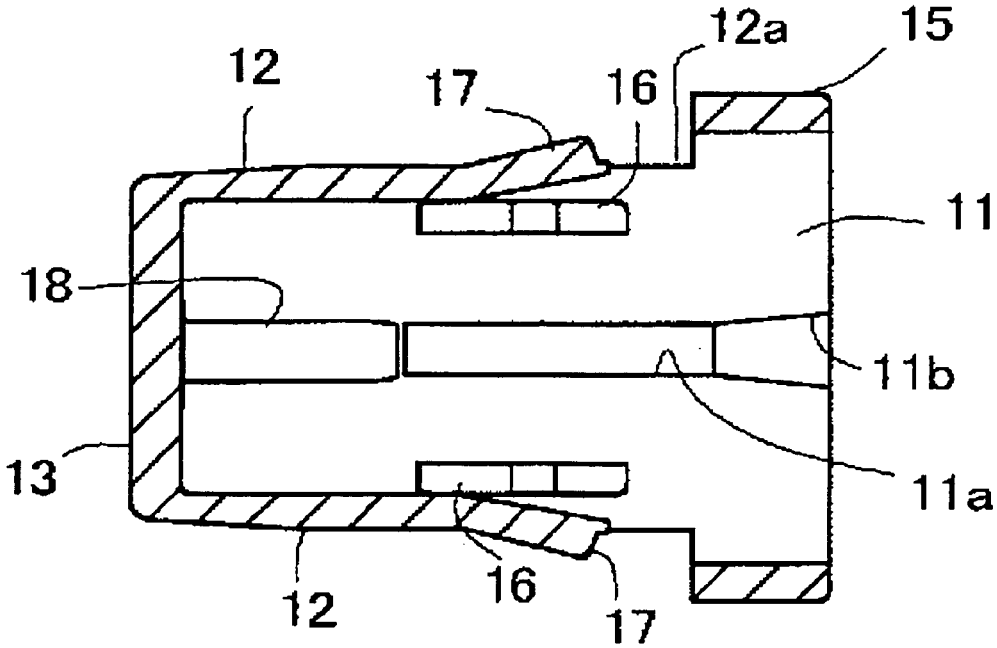
FIG. 5C is a cross-sectional view taken along a line VC-VC in FIG. 5A of the housing of the latch device.
Figure 5D:
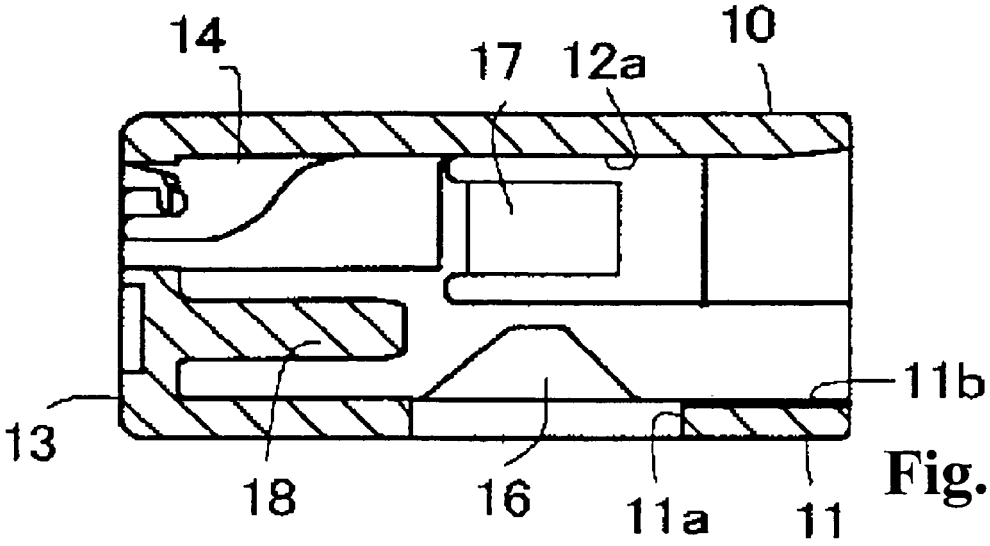
FIG. 5D is a cross-sectional view taken along a line VD-VD in FIG. 5B of a housing single item of the latch device.

When the above-mentioned door retaining state is switched to a releasing state of FIG. 4C, as shown in FIG. 4B, after the door is pushed in the closing direction, this pushing force is released. Then, both ends 5*c* of the pin member 5 move to the above-mentioned releasing guidance groove 27*d* from the above-mentioned locking groove 27*c*, and through the return groove 27*e*, the ends 5*c* return to the groove entrance again from the guidance groove 27*a*. At the same time, the engaging body 3 is switched to an initial release position.

Incidentally, in a prior latch device shown in FIGS. 8A, 8B, when an external force (external force in a direction of separating a door from a main body), in which the door is attempted to be open in a closed state of the door, is applied, an engaging body 1030 is pressed against a corresponding portion (an inner surface of a frame portion dividing an opening 1023*a*) of a sliding body 1020 by receiving a stress in a pullout direction of a striker 1090. In this structure, due to a frictional force produced at that moment, a high locking force between the engaging body 1030 and the striker 1090 can be obtained so as to prevent a condition in which the door is open abruptly. Also, in a case that an excessive external force is applied further to the door, the engaging body 1030 rotates in such a way as to retract a claw portion 1032*a* from a top of a striking portion 1022, i.e., the engaging body 1030 moves from the locking position to the locking release position so as to avoid a breakage. A pullout force at that time is called a forcibly-pullout strength. Specifically, in the prior structure, when the engaging body 1030 is positioned in the locking position, the claw portion 1032*a* is provided so as to be removed from an axis portion 1035, i.e., from a top of a rotational center line of the engaging body 1030. Also, when the stress in the pullout direction of the striker 1090 is received, a rotational moment as a supporting point of the axis portion 1035 is produced.

However, this rotational moment is proportional to an urging load or a spring load as a spring member 1040, and for example, if the spring load is set weakly, the forcibly-pullout strength also declines. Specifically, in the prior latch device, the forcibly-pullout strength has been determined by a frictional contact between the claw portion 1032*a* and an inner surface of the opening 1023*a* on a sliding body side, and the spring load of the spring member 1040. For this reason, in the prior structure, it was difficult to set a latch operational force and the like arbitrarily by separating from the forcibly-pullout strength, so that a degree of freedom for a design was restricted from that aspect.

Also, in the prior structure, as mentioned above, by pressing the claw portion 1032*a* against the corresponding portion of the sliding body 1020, or frictionally contacting the claw portion 1032*a* and the corresponding portion of the sliding body 1020, a target forcibly-pullout strength against the above-mentioned rotational moment is ensured. In a structure in which this claw portion 1032*a* frictionally contacts the corresponding portion of the sliding body 1020, for example, if a usage environment becomes a low temperature, then between members becomes frozen, and a pressure-contact resistance or a frictional resistance becomes large, so that a rotation of the engaging body is interfered with, and this causes a factor for an operational failure. Also, the forcibly-pullout strength becomes uneven, and a sliding sound due to a pressure contact or friction easily occurs. Incidentally, a technology of Patent Document 3 resolved such operational failure. However, since it requires a microfabrication, if it is downsized, an implementation is difficult to be carried out.

Figure 9A:
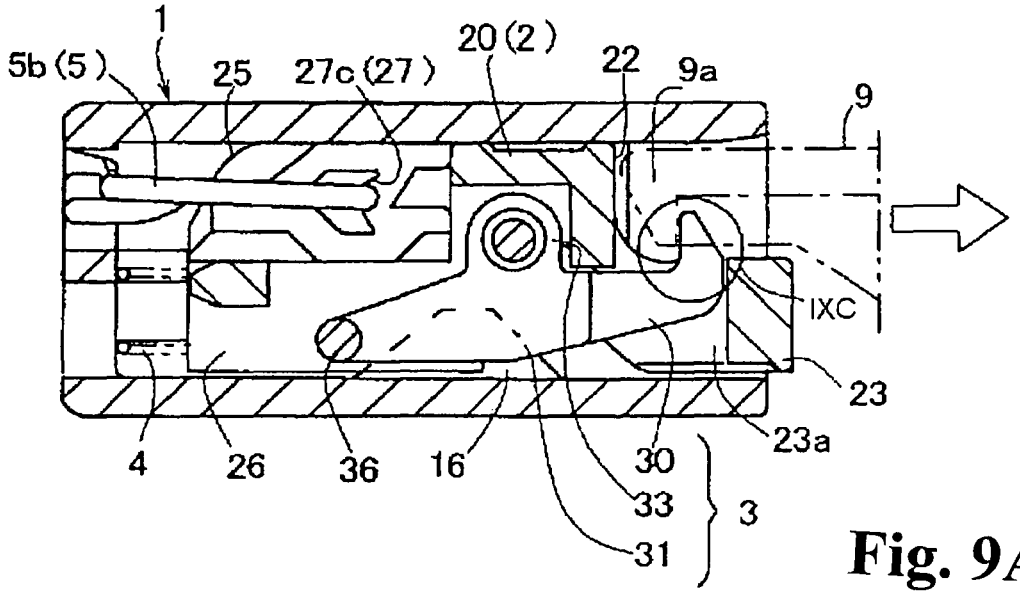
FIG. 9A is a cross-sectional view in a state wherein the striker receives the external force in the pullout direction.
Figure 9B:
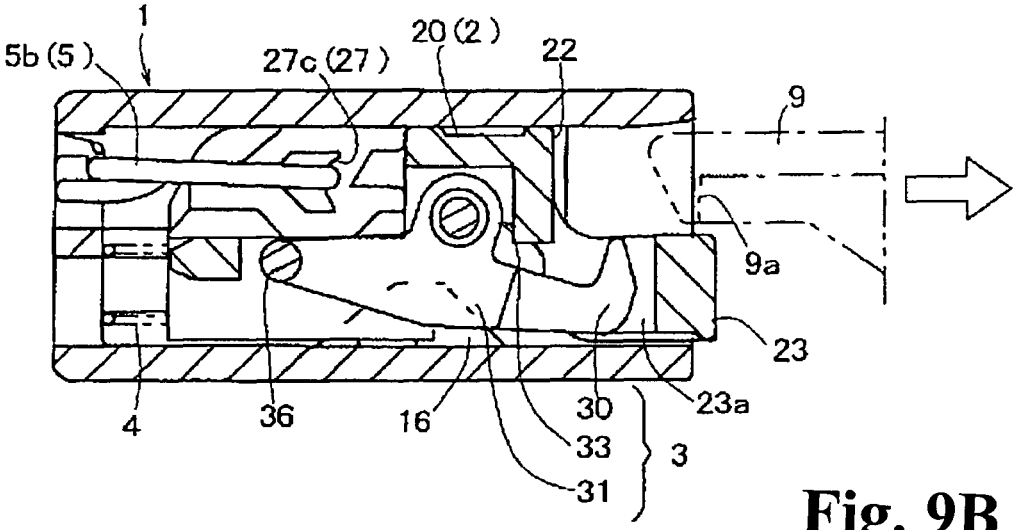
FIG. 9B is a cross-sectional view when the striker is forcibly pulled out.
Figure 9C:
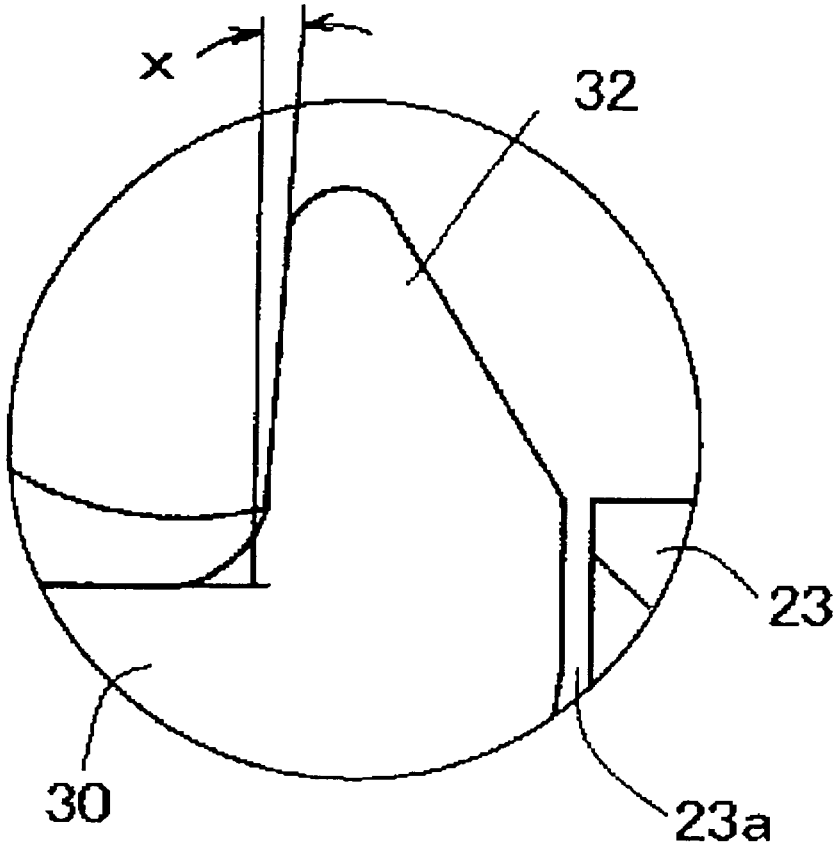
FIG. 9C is an enlarged view of an IXC portion in FIG. 9A.

However, in the structure of the present invention, the engaging body 3 is pivotally supported relative to the sliding body 2 in such a way that a rotational center line when the engaging body 3 rotates by the fitting of the axis portions and the axis holes 24*a* or as a supporting point of the pivotal supporting portion, and the claw portion 32 of the engaging body 3 in a state wherein the engaging body 3 is switched to the locking position, correspond in a pullout direction of the striker 9. For this reason, as shown in FIGS. 9A, 9C, when the external force, which attempts to open the door in the closed state (the engaging body 3 is in the locking position) of the above-mentioned door 8, i.e., when the external force in a right arrow direction in the same figures, is applied, for example, as long as the claw portion 32 and the claw 9*a* of the striker are abutted and engaged in parallel, the rotational moment (stress which attempts to rotate in a direction of releasing the locking of the engaging body 3) is not applied to the engaging body 3. Thereby, in this latch device, compared to a prior product, the following expansion is capable.

For example, in a case of structuring a latch device which can never be forcibly pulled out, the engaging body 3 may be supported to the above-mentioned sliding body in such a way that a line segment, connecting the axis portions 35 which are rotational centers of the engaging body 3 and the claw portion in a state wherein the above-mentioned engaging body 3 is positioned in the locking position, approximately corresponds to an engaging/disengaging direction of the striker 9. If the latch device is structured as described above, even if a forcibly-pullout force is applied to the striker 9, this force applies to the engaging body 3 as a force toward an outside of a radial direction from the rotational center, and the rotational moment does not occur in the engaging body 3. Also, it is preferable that a normal line of an abutting surface of the claw portion 9*a* of the striker 9, and a normal line of an abutting surface of the claw portion 32 of the engaging body 3 approximately correspond to the engaging/disengaging direction of the striker 9, so that a rotation of the engaging body 3 can be blocked more stably.

On the other hand, in a case of structuring a latch device which can be forcibly pulled out, the latch device may be designed such that the abutting surface of the claw 9*a* of the striker 9, and the abutting surface of the claw portion 32 of the engaging body 3 are abutted with a minute angle. As an example thereof, FIG. 9C shows a structure in which the abutting surface of the claw portion 32 relative to the striker 9 is tilted only for a minute angle x.

According to this structure, if a pullout force F is applied to the striker 9, since the abutting surface of the claw portion 32 is tilted relative to the striker 9 only for the minute angle x, a force of F·sin x is applied to the claw portion 32 of the engaging body 3 downwardly in FIG. 9C. If this force F·sin x becomes larger than a frictional resistance between the striker 9 and the claw portion 32, the claw portion slides on the striker 9, and the engaging body 3 rotates toward the locking release position. Therefore, if the angle x is appropriately selected, the forcibly-pullout strength of the latch device can be freely set.

In this way, in the latch device of the present invention, in order to ensure the forcibly-pullout strength, it is not necessary to press the claw portion against the corresponding portion (the inner surface of the frame portion dividing the opening) of the sliding body, or to frictionally contact the claw portion with the corresponding portion of the sliding body as in the prior art, so that even at a low temperature time, a stable operation can be maintained, and a problem of a sliding sound due to the pressure contact or friction can be easily resolved. Also, without being restricted by the frictional contact between the prior claw portion and the inner surface of the opening on the sliding body side, and the spring load of the spring member 4, the forcibly-pullout strength of the latch device can be freely set.

According to the latch device of the present invention, the claw portion 32 of the engaging body 3 does not frictionally contact with the inner surface of the opening 23*a* on the sliding body side. This is because, as shown in FIG. 9C, a gap is provided between the opening 23*a* and the claw portion 32. Consequently, in the latch device of the present invention, the forcibly-pullout strength can be set by an abutting shape between the claw portion 32 of the engaging body 3 and the claw 9*a* of the striker 9. Therefore, since the forcibly-pullout strength is little affected by the spring load of the spring member 4, the latch operational force and the like can be arbitrarily set, and the degree of freedom for the design can be improved.

Incidentally, the present invention is not limited to the embodiments described hereinabove, and can be variously modified. As one example thereof, a structure pivotally supporting the engaging body 3 to the sliding body 2 may be the structure in which the axis portions in place of the axis holes 24*a* are provided in the sliding body 2, and the axis holes in place of the axis portions 35 are provided in the engaging-body 3, so that the engaging body 3 is pivotally supported relative to the sliding body 2 through the fitting of the axis portions and the axis holes, and furthermore the structure in which the axis holes are provided both in the sliding body 2 and the engaging body 3, so that the engaging body 3 is pivotally supported relative to the sliding body 2 through a shaft which is passed through both of the axis holes.

Although the present invention was explained in detail with reference to a specific embodiment, it is obvious for one skilled in the art that the invention is capable of various modifications or amendments without departing from the spirit and scope of the present invention.

The present application is based on Japanese Patent Applications No. 2008-277545 filed on Oct. 29, 2008 and No. 2008-277549 filed on Oct. 29, 2008, and all contents thereof are incorporated in their entireties herein as references.

INDUSTRIAL APPLICABILITY

According to the latch device of the present invention, a further compact latch device can be provided while a locking force or a rigidity force of the engaging body are being maintained as much as possible, and usages of the latch device can be expanded.

EXPLANATION OF SYMBOLS

1 . . . Housing
16 . . . Overhang portion
18 . . . Supporting axis
2 . . . Sliding body
20 . . . Main body
21 . . . Back extending portion
22 . . . Striking portion
24*a* . . . Axis holes
27 . . . Cam groove
27*c* . . . Locking groove
3 . . . Engaging body
30 . . . Front plate portion
31 . . . Back piece portions
32 . . . Claw portion
33 . . . Protruding portions
35 . . . Axis portions
4 . . . Spring member
5 . . . Pin member
7 . . . Main body of equipment
8 . . . Door
9 . . . Striker as an engaged/disengaged member

What is claimed is:

1. A latch device, comprising:

a housing;

a sliding body including a striking portion abutting against an engaged/disengaged member, and a cam groove, and disposed relative to the housing so as to be capable of advancing and retracting;

a spring member urging the sliding body in a direction such that the sliding body protrudes from the housing;

an engaging body rotatably supported relative to the sliding body, and including a claw portion on an end of the engaging body; and a pin member moving in such a way as to trace the cam groove, wherein the engaging body moves between a locking position wherein the claw portion is protruded to a striking portion side of the sliding body and engages with the engaged/disengaged member, and a locking release position wherein the claw portion is retracted from the striking portion side and is released from engagement with the engaged/disengaged member, wherein when the sliding body is pressed and the sliding body moves against an urging force of the spring member, the sliding body is retained in a position after a movement thereof through cooperation between the cam groove and the pin member, and the engaging body moves from the locking release position to the locking position, wherein the engaging body includes a front plate portion from which the claw portion extends, a back piece portion projecting backward from the front plate portion, and protruding portions formed in a middle of the engaging body and protruding from the back piece portion in a same direction as a protruding direction of the claw portion, wherein pivotal supporting portions, rotatably supporting the engaging body to the sliding body, are provided on the protruding portions, and wherein in a state in which the engaging body is positioned in the locking position, the striking portion of the sliding body is positioned between the claw portion and the protruding portions, and a line segment connecting one of the pivotal supporting portions, and the claw portion in a state where the engaging body is positioned in the locking position, approximately corresponding to an engaging/disengaging direction of the engaged/disengaged member, wherein the pivotal supporting portions from a rotational center of the engaging body, and the protruding portions and the claw portion protrude substantially perpendicular to an upper surface of the front plate portion.

2. A latch device according to claim 1, wherein the sliding body includes:

an approximately inverted U-shaped main body; and a back extending portion protruding towards a backward portion of the main body, and including a narrow width portion whose width is narrower than that of the main body, wherein the cam groove is formed in the narrow width portion, wherein the striking portion is a front end surface of the inverted U-shaped main body, wherein axis holes or axis portions for the pivotal supporting portions are provided on side surfaces of the main body, and wherein the projecting portions run on an overhang portion provided inside the housing while the engaging body moves towards the narrow width portion of the back extending portion, so that the engaging body moves from the locking position to the locking release position.

3. A latch device according to claim 1, wherein the back piece portion includes projecting portions provided on side surfaces thereof, and wherein the projecting portions run on an overhang portion provided inside the housing so that the engaging body moves from the locking position to the locking release position.

4. A latch device according to claim 2, wherein the sliding body has a frame portion comprising an opening from which the claw portion protrudes and retracts, and the front plate portion has a predetermined length so that the engaging body rotates with respect to the pivotal supporting portions without a contact between the claw portion and a surface of the opening.

5. A latch device according to claim 1, wherein the back piece portion has an upper surface, the protruding direction of the protruding portions being an upward direction from both upper surfaces of the front plate portion and the back piece portion.

* * * * *